US011176861B2

(12) United States Patent
Tzeng et al.

(10) Patent No.: US 11,176,861 B2
(45) Date of Patent: Nov. 16, 2021

(54) ELECTRONIC DEVICE AND DISPLAY DRIVER CHIP

(71) Applicant: NOVATEK Microelectronics Corp., Hsinchu (TW)

(72) Inventors: Syang-Yun Tzeng, Taoyuan (TW); Cheng-Tsu Hsieh, Taoyuan (TW); Ching-Wen Hou, Hsinchu (TW); Ying-Hsiang Wang, New Taipei (TW); Ping Chen, Tainan (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/088,600

(22) Filed: Nov. 4, 2020

(65) Prior Publication Data

US 2021/0150954 A1 May 20, 2021

Related U.S. Application Data

(60) Provisional application No. 62/937,805, filed on Nov. 20, 2019, provisional application No. 62/952,500, filed on Dec. 23, 2019.

(51) Int. Cl.
*G09G 3/00* (2006.01)

(52) U.S. Cl.
CPC ..... *G09G 3/035* (2020.08); *G09G 2310/0289* (2013.01); *G09G 2310/0291* (2013.01); *G09G 2380/02* (2013.01)

(58) Field of Classification Search
CPC ... G09G 2310/0289; G09G 2310/0291; G09G 2380/02; G09G 3/035; G02F 1/13454; H03F 1/523; H03F 3/45977; H03F 3/45753; H03F 3/45183; H01L 23/50
See application file for complete search history.

(56) References Cited

U.S. PATENT DOCUMENTS 8,823,457 B1 * 9/2014 Mossawir ..... H03F 1/523 330/298
2003/0034833 A1 * 2/2003 Udo ..... H03F 3/45753 330/9
2003/0103029 A1 * 6/2003 Kokubun ..... H03F 3/45753 345/99

(Continued)

FOREIGN PATENT DOCUMENTS

CN 101656534 A 2/2010
CN 108053799 A 5/2018

(Continued)

*Primary Examiner* — Richard J Hong
(74) *Attorney, Agent, or Firm* — CKC & Partners Co., LLC

(57) ABSTRACT

An electronic device includes a substrate and a display driver chip bonded on the substrate. The display driver chip includes a plurality of operational amplifiers, and each of the operational amplifiers has a first stage and a second stage. The first stage includes a first power input terminal. The second stage includes a first power input terminal and an output terminal for outputting an output voltage. The first power input terminal of the first stage is connected to a first metal trace of the substrate, and the first power input terminal of the second stage is connected to a second metal trace of the substrate. The first power input terminal of the first stage and the first power input terminal of the second stage are both provided with a first voltage level.

28 Claims, 24 Drawing Sheets

(56) References Cited

U.S. PATENT DOCUMENTS

| | | | | |
|---|---|---|---|---|
| 2003/0117082 | A1 | 6/2003 | Tam | |
| 2006/0012430 | A1* | 1/2006 | Fifield | H03F 3/45183 330/253 |
| 2006/0202750 | A1* | 9/2006 | Nishimori | H03F 3/45977 330/9 |
| 2007/0206136 | A1* | 9/2007 | Lin | G02F 1/13454 349/106 |
| 2011/0080214 | A1 | 4/2011 | Tsuchi | |
| 2018/0286798 | A1* | 10/2018 | Waidhas | H01L 23/50 |

FOREIGN PATENT DOCUMENTS

| | | | |
|---|---|---|---|
| TW | 201017611 | A | 5/2010 |
| TW | M560677 | U | 5/2018 |

* cited by examiner

ELECTRONIC DEVICE AND DISPLAY DRIVER CHIP

RELATED APPLICATIONS

This application claims priority to U.S. Provisional Application Ser. No. 62/937,805, filed Nov. 20, 2019, and U.S. Provisional Application Ser. No. 62/952,500, filed Dec. 23, 2019, which are herein incorporated by reference in their entirety.

BACKGROUND

Field of Invention

The present invention relates to an electronic device and a display driver chip.

Description of Related Art

An operational amplifier is a widely used element for realizing a variety of circuit functions. Taking driving circuits of a liquid crystal display (LCD) as an example, the operational amplifier can be used as an output buffer, which charges or discharges loads, i.e. liquid crystals, according to analog signals outputted by a front stage digital to analog converter (DAC), for driving corresponding pixel units on the LCD.

However, with increases in size and resolution of the LCD, data quantity processed by the driving circuits is also increasing significantly, so that response speed of the operational amplifier, also called slew rate, has to be enhanced as well.

SUMMARY

According to some embodiments of the invention, an electronic device includes a substrate and a display driver chip bonded on the substrate. The display driver chip includes a plurality of operational amplifiers, and each of the operational amplifiers has a first stage and a second stage. The first stage includes a first power input terminal. The second stage includes a first power input terminal and an output terminal for outputting an output voltage. The first power input terminal of the first stage is connected to a first metal trace of the substrate, and the first power input terminal of the second stage is connected to a second metal trace of the substrate. The first power input terminal of the first stage and the first power input terminal of the second stage are both provided with a first voltage level.

According to some other embodiments of the invention, a display driver chip includes a molding compound and a die embedded in the molding compound, the die includes a plurality of operational amplifiers, and each of the operational amplifiers has a first stage and a second stage. The first stage includes a first power input terminal connected to a first pad that is exposed from the molding compound. The second stage includes a first power input terminal and an output terminal for outputting an output voltage. The first power input terminal of the second stage is connected to a second pad that is exposed from the molding compound. The first power input terminal of the first stage and the first power input terminal of the second stage are both provided with a first voltage level.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1B:
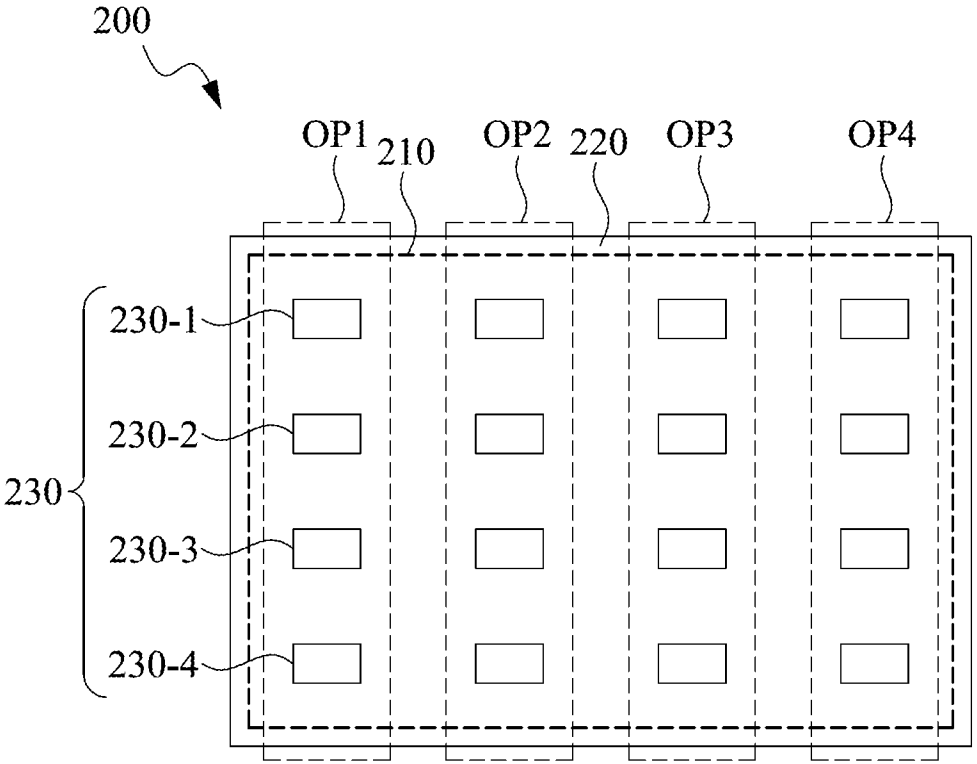
FIG. 1B is a bottom view of a display driver chip having a plurality of operational amplifiers of FIG. 1A.

Reference will now be made in detail to the present embodiments of the invention, examples of which are illustrated in the accompanying drawings. Wherever possible, the same reference numbers are used in the drawings and the description to refer to the same or like parts.

Figure 1A:
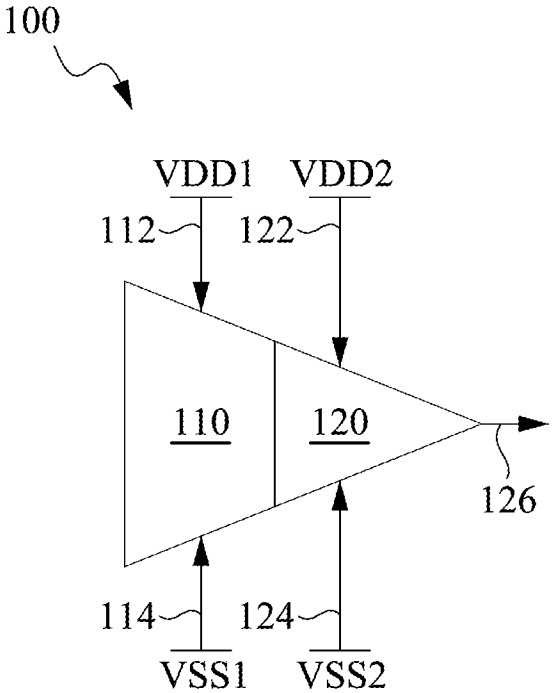
FIG. 1A is a schematic diagram of an operational amplifier according to a first embodiment of the present invention.

FIG. 1A is a schematic diagram of an operational amplifier 100 according to a first embodiment of the present invention. In some embodiments, the operational amplifier 100 is a two-stage structure, which includes a first stage 110 having an amplification circuit (amplification stage) and a second stage 120 having an output circuit (output stage). The first stage 110 is utilized for increasing current or voltage gain of the operational amplifier, while the second stage 120 is utilized for driving capacitive or resistive loads connected to the operational amplifier. Therefore, the first stage 110 is also called as input stage or gain stage, and the second stage 120 is also called as output stage, in some embodiments.

The first stage 110 of the operational amplifier 100 includes a first power input terminal 112 and a second power input terminal 114. The second stage 120 of the operational amplifier 100 includes a first power input terminal 122 and a second power input terminal 124. The second stage 120 of the operational amplifier 100 further includes an output terminal 126 for outputting an output voltage, for driving one or more pixels of a panel.

Figure 1C:
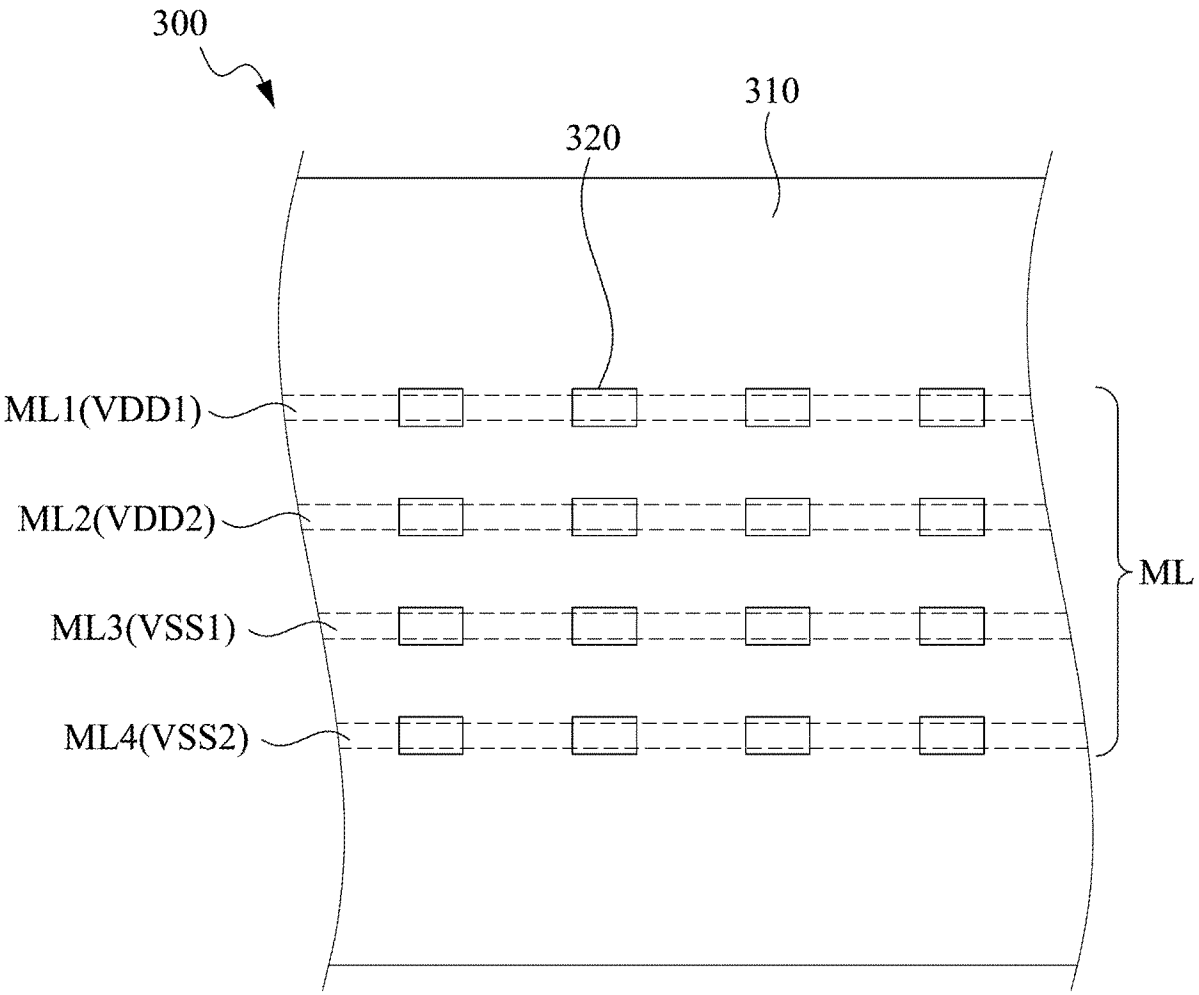
FIG. 1C is a schematic top view of a substrate for carrying and communicating to the display driver chip of FIG. 1B.

FIG. 1B is a bottom view of a display driver chip 200 having a plurality of operational amplifiers 100 of FIG. 1A, and FIG. 1C is a schematic top view of a substrate 300 for carrying and communicating to the display driver chip 200 of FIG. 1B. As shown in FIG. 1B, the display driver chip 200 includes at least one die 210 and a molding compound 220, in which the die 210 is embedded in the molding compound 220 and has a plurality of pads 230 exposed from the molding compound 220. The pads 230 are corresponding to the operational amplifiers, and the number and the arrangement of the pads 230 of this embodiment are not utilized to limit the present invention.

For example, the die 210 includes four operational amplifiers, and the pads 230 are arranged and can be grouped as four regions OP1-OP4. As shown in the region OP1, there are four pads 230-1 to 230-4 in the region OP1, and the first to fourth pads 230-1 to 230-4 are respectively connected to the first power input terminal 112 of the first stage 110 of the operational amplifier 100, the first power input terminal 122 of the second stage 120 of the operational amplifier 100, the second power input terminal 114 of the first stage 110 of the operational amplifier 100, and the second power input terminal 124 of the second stage 120 of the operational amplifier 100 of FIG. 1A. It is noted that the pad connecting to the output terminal 126 of the second stage 120 of the operational amplifier 100 of FIG. 1A is not illustrated in FIG. 1B. The arrangements of the pads 230 of the region OP2-OP4 are substantially the same as the region OP1.

Referring to FIG. 1C, a substrate 300 is provided, and FIG. 1C only illustrates a portion of the substrate 300. The substrate 300 has a plurality of metal traces ML, and the metal traces ML are respectively connected to the corresponding pads 230 of the display driver chip 200 as shown in FIG. 1B. For example, the metal traces ML includes a first metal trace ML1, a second metal trace ML2, a third metal trace ML3, and a fourth metal trace ML4. The substrate 300 is provided to carry the display driver chip 200 and to communicate the display driver chip 200 to a panel.

In some embodiments, a passivation layer 310 is formed on the substrate 300 to protect the metal traces ML. The passivation layer 310 has a plurality of openings, and a plurality of bumps 320 are formed in the openings, such that the metal traces ML are connected to the corresponding bumps 320. In some embodiments, the arrangement of the bumps 320 on the substrate 300 is designed according to the arrangement of the pads 230 of the display driver chip 200.

Reference is made to FIGS. 1A-1C. After the display driver chip 200 is bonded on the substrate 300, the first pad 230-1 is connected to the first metal trace ML1 through the bump 320, such that the first power input terminal 112 of the first stage 110 of the operational amplifier 100 is connected to the first metal trace ML1. The second pad 230-2 is connected to the second metal trace ML2 through the bump 320, such that the first power input terminal 122 of the second stage 120 of the operational amplifier 100 is connected to the second metal trace ML2 through the bump 320. The third pad 230-3 is connected to the third metal trace ML3 through the bump 320, such that the second power input terminal 114 of the first stage 110 of the operational amplifier 100 is connected to the third metal trace ML3. The fourth pad 230-4 is connected to the fourth metal trace ML4 through the bump 320, such that the second power input terminal 124 of the second stage 120 of the operational amplifier 100 is connected to the fourth metal trace ML4.

The first metal trace ML1 and the second metal trace ML2 are both provided with a first voltage level, and the third metal trace ML3 and the fourth metal trace ML4 are both provided with a second voltage level. In some embodiments, the first metal trace ML1 and the second metal trace ML2 are provided with a high voltage level and can be regarded as high voltage lines (VDD1 and VDD2). In some embodiments, the third metal trace ML3 and the fourth metal trace ML4 are provided with a low voltage level and can be regarded as low voltage lines (VSS1 and VSS2). In some embodiments, the voltage between the high voltage level and the low voltage level is positive, and the output terminal 126 outputs positive channel outputs. In some embodiments, the voltage between the high voltage level and the low voltage level is negative, and the output terminal 126 outputs negative channel outputs.

As a result, the first power input terminal 112 and the first power input terminal 122 of the operational amplifier 100 are individually provided with the high voltage level (VDD1 and VDD2), and the second power input terminal 114 and the second power input terminal 124 of the operational amplifier 100 are individually provided with the low voltage level (VSS1 and VSS2). By separating the routing of VDD source and VSS source of the operational amplifier 100, the effect of the voltage variation of VDD source and VSS source due to the slew rate, especially at heavy load, can be reduced, such that the image quality can be improved. More particularly, the VSS source and VDD source of the operational amplifier 100 are separated as VSS1, VSS2, VDD1, VDD2, and have the corresponding individual pads 230-1 to 230-4 of the display driver chip 200 and the corresponding individual bumps 320 on the substrate 300. Thus the voltage variation of the output stage (e.g. VSS2 and VDD2 of the second stage 120) of the operational amplifier 100, caused by outputting a heavy load image, would not affect the input or gain stage (e.g. VSS1 and VDD1 of the first stage 110) of the operational amplifier 100, and operational amplifier slew rate can be well controlled.

Figure 2B:
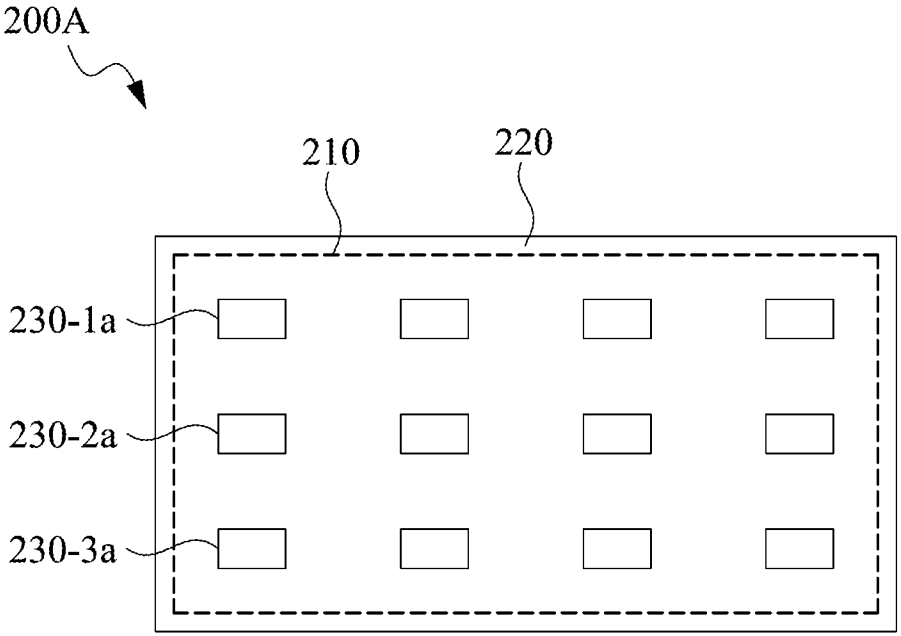
FIG. 2B is a bottom view of a display driver chip having a plurality of operational amplifiers of FIG. 2A.
Figure 2A:
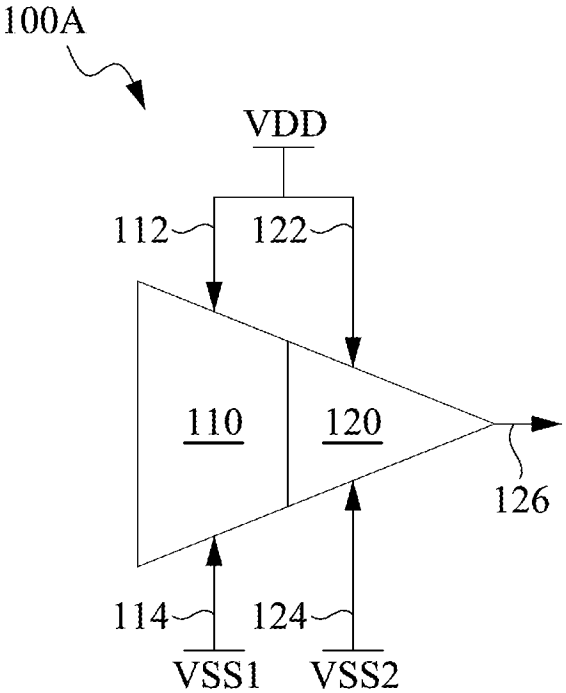
FIG. 2A is a schematic diagram of an operational amplifier according to a second embodiment of the present invention.
Figure 2C:
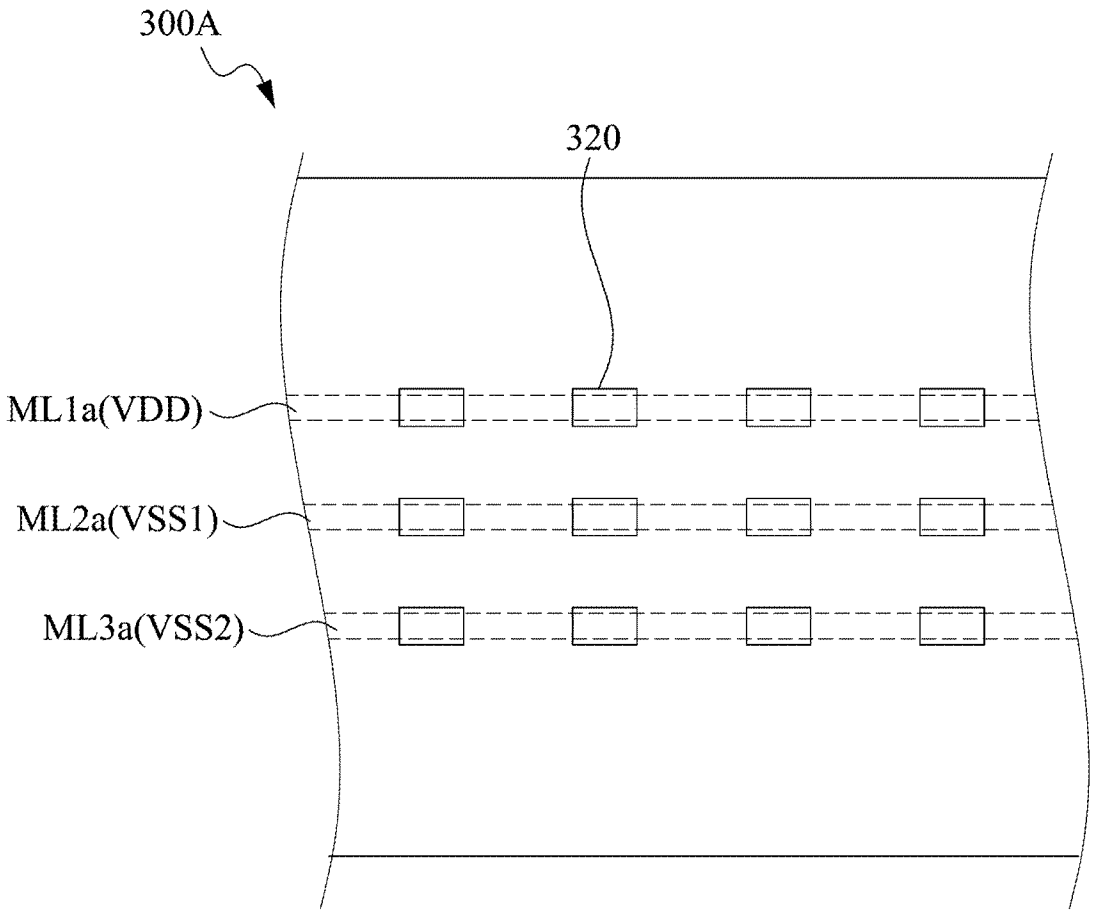
FIG. 2C is a schematic top view of a substrate for carrying and communicating to the display driver chip of FIG. 2B.

Reference is made to FIGS. 2A to 2C, in which FIG. 2A is a schematic diagram of an operational amplifier 100A according to a second embodiment of the present invention, FIG. 2B is a bottom view of a display driver chip 200A having a plurality of operational amplifiers 100A of FIG. 2A, and FIG. 2C is a schematic top view of a substrate 300A for carrying and communicating to the display driver chip 200A of FIG. 2B.

One of the differences between the second embodiment and the first embodiment lies on that the first power input terminals 112 and 122 of the operational amplifier 100A are both connected to the pad 230-1*a* of the corresponding OP region of the display driver chip 200A, the second power input terminal 114 of the operational amplifier 100A is connected to the pad 230-2*a* of the corresponding OP region of the display driver chip 200A, and the second power input terminal 124 of the operational amplifier 100A is connected to the pad 230-3*a* of the corresponding OP region of the display driver chip 200A.

Another one of the differences between the second embodiment and the first embodiment lies on that the pad 230-1*a* of the display driver chip 200A is connected to the metal trace ML1*a* of the substrate 300A, which is provided with the high voltage level (VDD), such that the first power input terminal 112 of the first stage 110 of the operational amplifier 100A and the first power input terminal 122 of the second stage 120 of the operational amplifier 100A are commonly provided with the high voltage level (VDD). The pads 230-2*a* and 230-3*a* of the display driver chip 200A are respectively connected to the metal traces ML2*a* and ML3*a* of the substrate 300A, which are provided with the low voltage level (VSS1 and VSS2), such that the second power input terminal 114 of the first stage 110 of the operational amplifier 100A and the second power input terminal 124 of the second stage 120 of the operational amplifier 100A are individually provided with the low voltage levels (VSS1 and VSS2). By separating the routing of VSS source of the operational amplifier 100A, the effect of the voltage variation of VSS source due to the slew rate, especially at heavy load, can be reduced, such that the image quality can be improved. More particularly, the VSS source of the operational amplifier 100A is separated as VSS1 and VSS2, and VSS1 and VSS2 have the corresponding individual pads 230-2*a* and 230-3*a* of the display driver chip 200A and the corresponding individual bumps 320 on the substrate 300A. Thus the voltage variation of the output stage (e.g. VSS2 of the second stage 120) of the operational amplifier 100A, caused by outputting a heavy load image, would not affect the input or gain stage (e.g. VDD and VSS1 of the first stage 110) of the operational amplifier 100A, and operational amplifier slew rate can be well controlled.

Figure 3B:
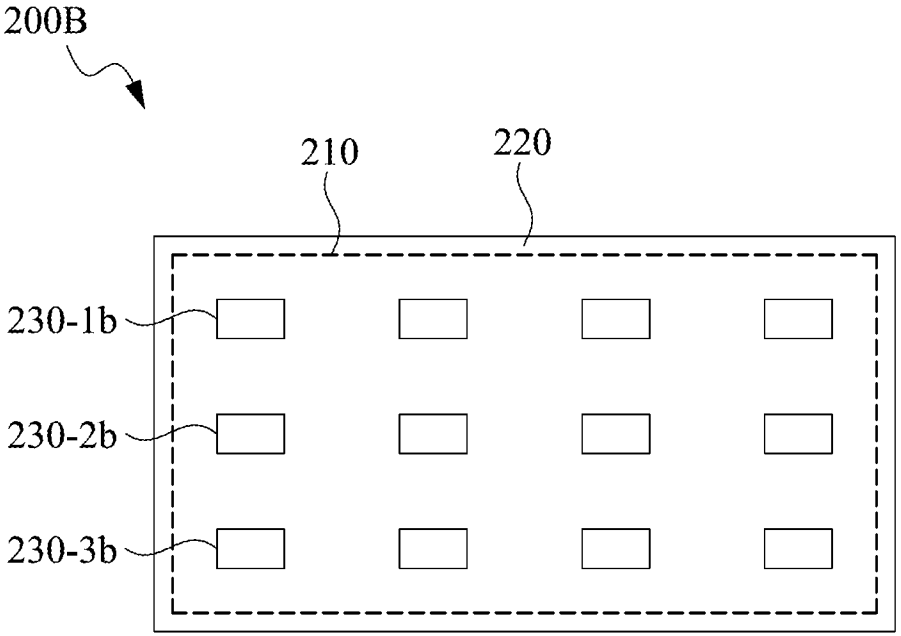
FIG. 3B is a bottom view of a display driver chip having a plurality of operational amplifiers of FIG. 3A.
Figure 3A:
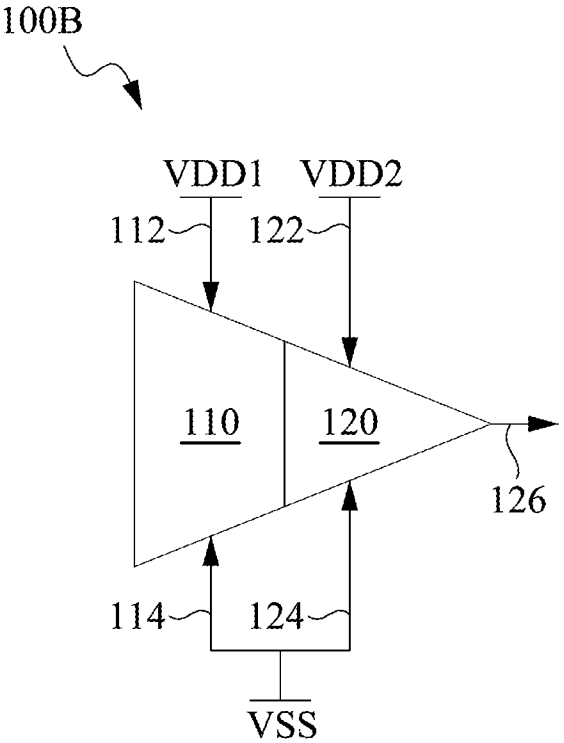
FIG. 3A is a schematic diagram of an operational amplifier according to a third embodiment of the present invention.
Figure 3C:
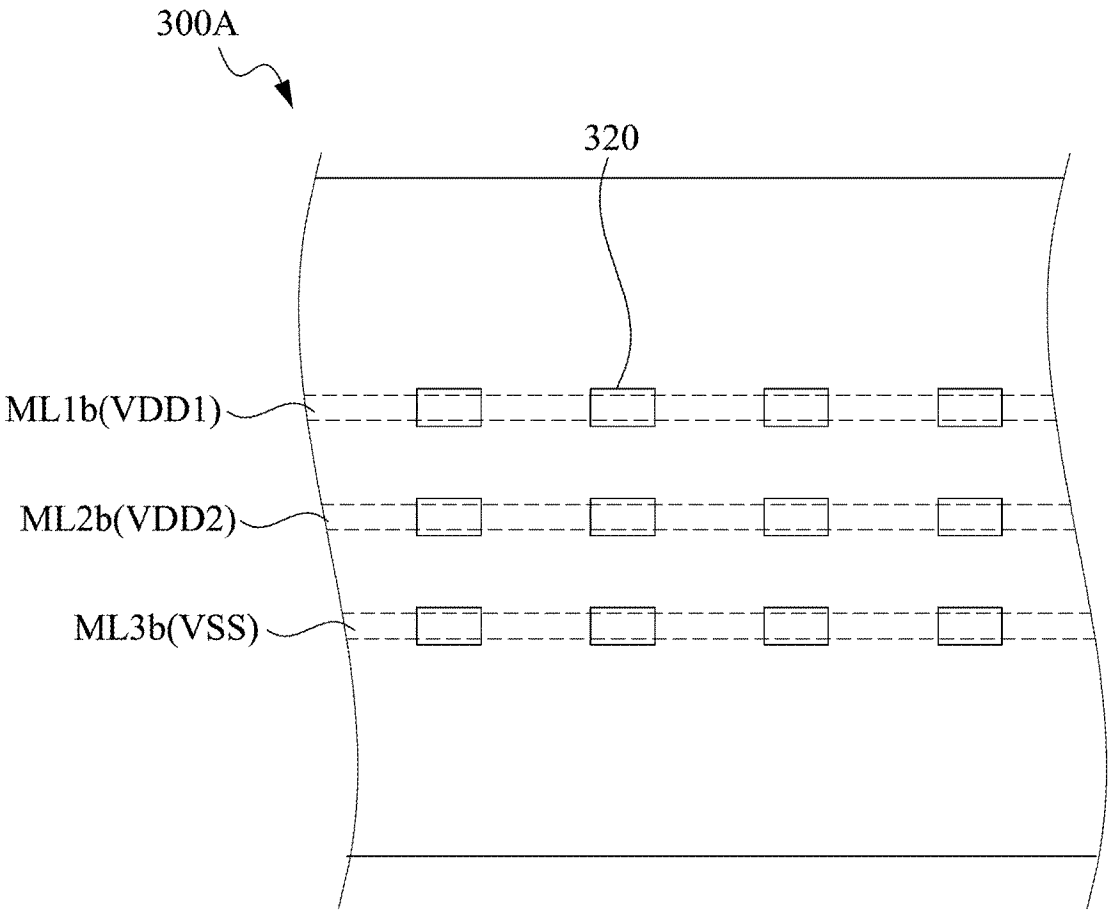
FIG. 3C is a schematic top view of a substrate for carrying and communicating to the display driver chip of FIG. 3B.

Reference is made to FIGS. 3A to 3C, in which FIG. 3A is a schematic diagram of an operational amplifier 100B according to a third embodiment of the present invention, FIG. 3B is a bottom view of a display driver chip 200B having a plurality of operational amplifiers 100B of FIG. 3A, and FIG. 3C is a schematic top view of a substrate 300B for carrying and communicating to the display driver chip 200B of FIG. 3B.

One of the differences between the third embodiment and the first embodiment lies on that the first power input terminals 112 and 122 of the operational amplifier 100B are respectively connected to the pads 230-1*b* and 230-2*b* of the corresponding OP region of the display driver chip 200B, and the second power input terminals 114 and 124 of the operational amplifier 100B are both connected to the pad 230-3*b* of the corresponding OP region of the display driver chip 200B.

Another one of the differences between the third embodiment and the first embodiment lies on that the pads 230-1*b* and 230-2*b* of the display driver chip 200B are respectively connected to the metal traces ML1*b* and ML2*b* of the substrate 300B, which are provided with the high voltage level (VDD1 and VDD2), such that the first power input terminal 112 of the first stage 110 of the operational amplifier 100B and the first power input terminal 122 of the second stage 120 of the operational amplifier 100B are respectively provided with the high voltage level (VDD1 and VDD2). The pad 230-3*b* of the display driver chip 200B is connected to the metal trace ML3*b* of the substrate 300B, which is provided with the low voltage level (VSS), such that the second power input terminal 114 of the first stage 110 of the operational amplifier 100B and the second power input terminal 124 of the second stage 120 of the operational amplifier 100B are commonly provided with the low voltage level (VSS). By separating the routing of VDD source of the operational amplifier 100B, the effect of the voltage variation of VDD source due to the slew rate, especially at heavy load, can be reduced, such that the image quality can be improved. More particularly, the VDD source of the operational amplifier 100B is separated as VDD1 and VDD2, and VDD1 and VDD2 have the corresponding individual pads 230-1*b* and 230-2*b* of the display driver chip 200B and the corresponding individual bumps 320 on the substrate 300B. Thus the voltage variation of the output stage (e.g. VDD2 of the second stage 120) of the operational amplifier 100B, caused by outputting a heavy load image, would not affect the input or gain stage (e.g. VDD1 and VSS of first stage 110) of the operational amplifier 100B, and operational amplifier slew rate can be well controlled.

Figure 4B:
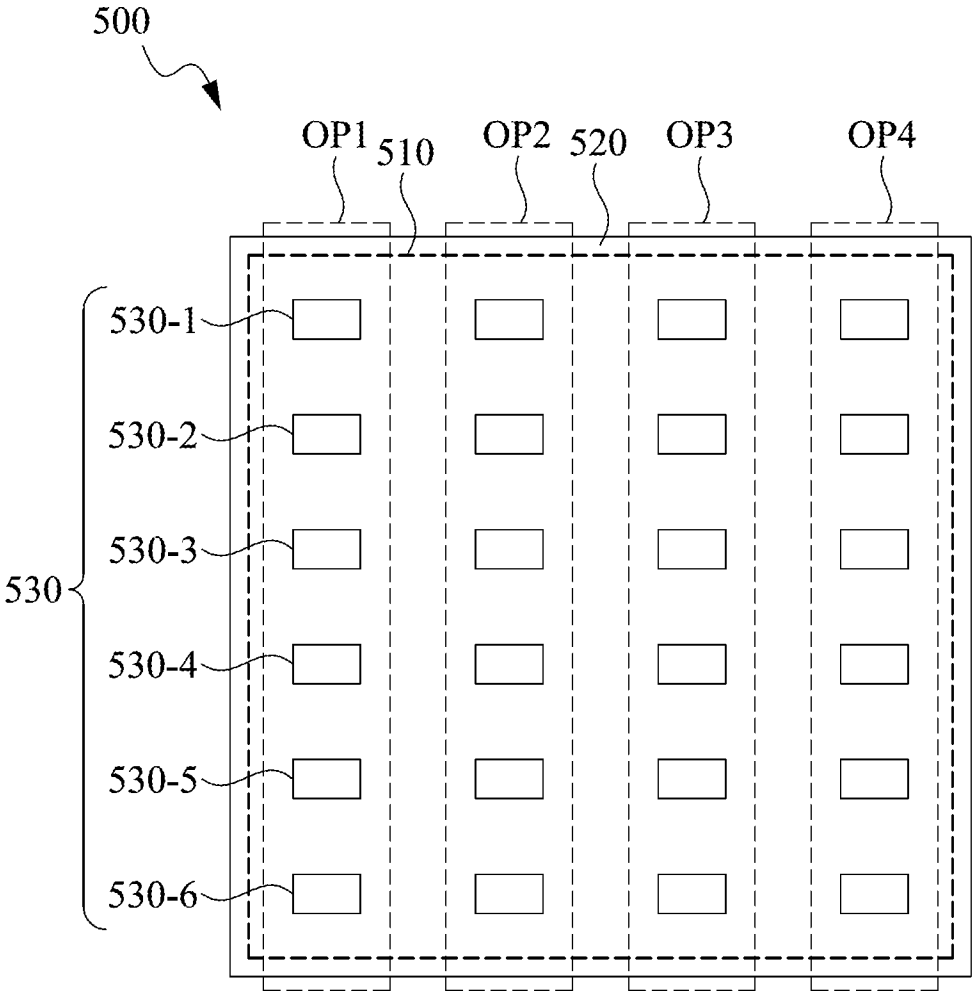
FIG. 4B is a bottom view of a display driver chip having a plurality of operational amplifiers of FIG. 4A.
Figure 4A:
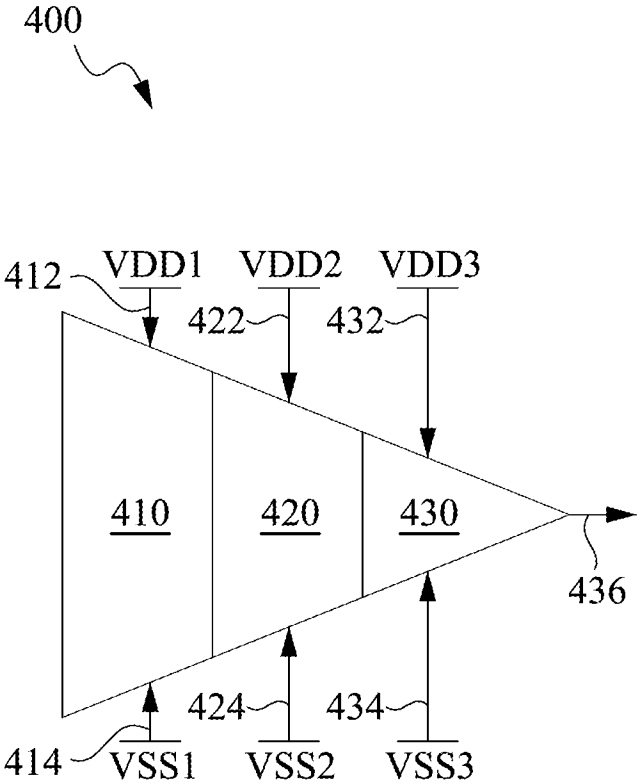
FIG. 4A is a schematic diagram of an operational amplifier according to a fourth embodiment of the present invention.
Figure 4C:
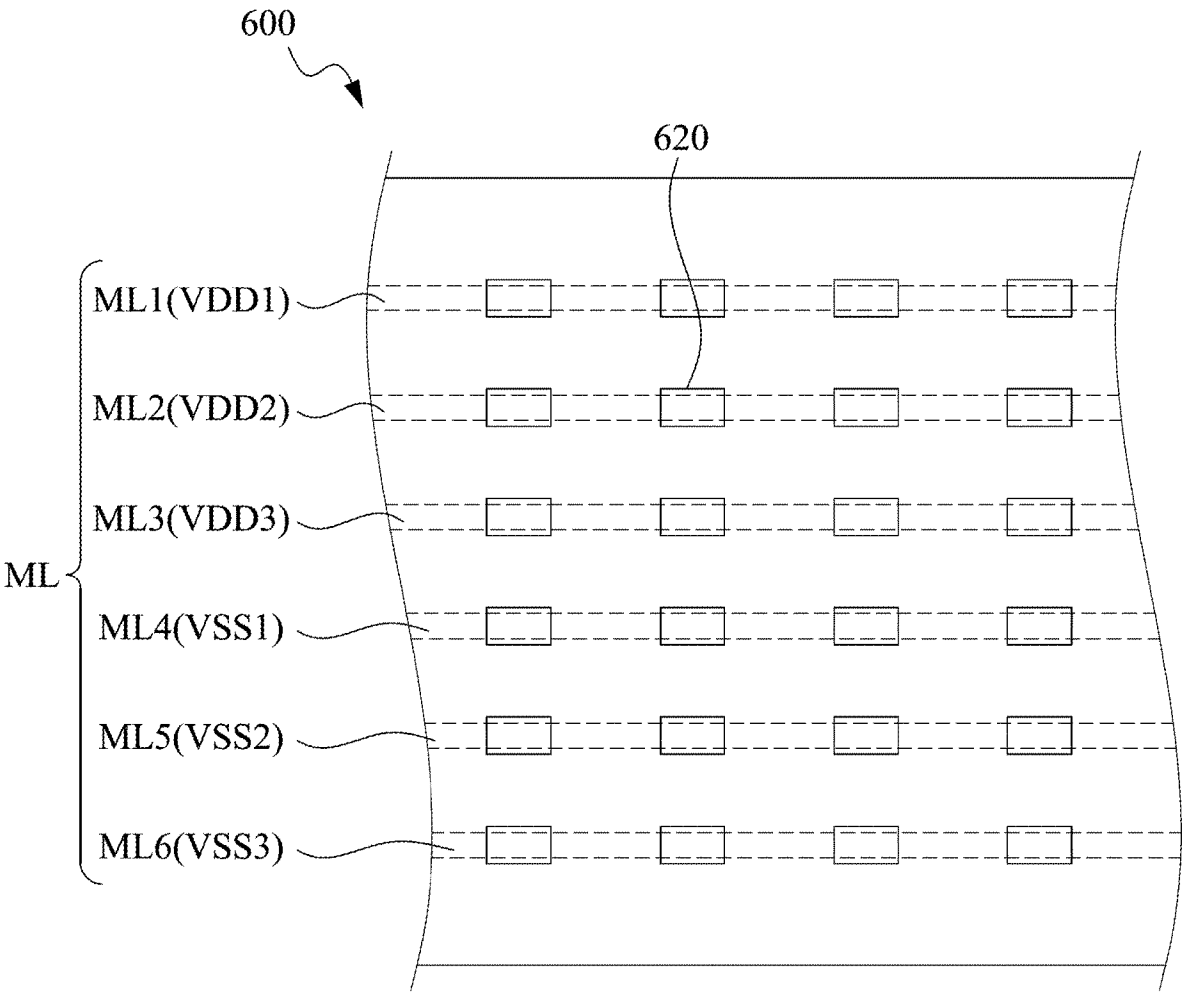
FIG. 4C is a schematic top view of a substrate for carrying and communicating to the display driver chip of FIG. 4B.

Reference is made to FIGS. 4A to 4C, in which FIG. 4A is a schematic diagram of an operational amplifier 400 according to a fourth embodiment of the present invention, FIG. 4B is a bottom view of a display driver chip 500 having a plurality of operational amplifiers 400 of FIG. 4A, and FIG. 4C is a schematic top view of a substrate 600 for carrying and communicating to the display driver chip 500 of FIG. 4B.

As shown in FIG. 4A, in some other embodiments, the operational amplifier 400 is a three-stage structure, which includes a first stage 410 having an input circuit (input stage), a second stage 420 having an amplification circuit (gain stage), and a third stage 430 having an output circuit (output stage). The second stage 420 is coupled between the first stage 410 and the third stage 430. The first stage 410 of the operational amplifier 400 includes a first power input terminal 412 and a second power input terminal 414. The second stage 420 of the operational amplifier 400 includes a first power input terminal 422 and a second power input terminal 424. The third stage 430 of the operational amplifier 400 includes a first power input terminal 432 and a second power input terminal 434. The third stage 430 of the operational amplifier 400 further includes an output terminal 436 for outputting an output voltage, for driving one or more pixels of a panel.

As shown in FIG. 4B, the display driver chip 500 includes at least one die 510 and a molding compound 520, in which the die 510 is embedded in the molding compound 520 and has a plurality of pads 530 exposed from the molding compound 520. The pads 530 are corresponding to the operational amplifiers, and the number and the arrangement of the pads 530 of this embodiment are not utilized to limit the present invention.

For example, the die 510 includes four operational amplifiers, and the pads 530 are arranged and can be grouped as four regions OP1-OP4. As shown in the region OP1, there are six pads 530-1 to 530-6 in the region OP1, and the first to sixth pads 530-1 to 530-6 are respectively connected to the first power input terminal 412 of the first stage 410 of the operational amplifier 400, the first power input terminal 422 of the second stage 420 of the operational amplifier 400, the first power input terminal 432 of the third stage 430 of the operational amplifier 400, the second power input terminal 414 of the first stage 410 of the operational amplifier 400, the second power input terminal 424 of the second stage 420 of the operational amplifier 400, and the second power input terminal 434 of the third stage 430 of the operational amplifier 400 of the operational amplifier 100 of FIG. 4A. It is noted that the pad connecting to the output terminal 436 of the third stage 420 of the operational amplifier 400 of FIG. 4A is not illustrated in FIG. 4B. The arrangements of the pads 530 of the region OP2-OP4 are substantially the same as the region OP1.

As shown in FIG. 4C, a substrate 600 is provided, and FIG. 4C only illustrates a portion of the substrate 600. The substrate 600 has a plurality of metal traces ML, and the metal traces ML are respectively connected to the corresponding pads 530 of the display driver chip 500 as shown in FIG. 4B. For example, the metal traces ML includes a first metal trace ML1, a second metal trace ML2, a third metal trace ML3, a fourth metal trace ML4, a fifth metal trace ML5, and a sixth metal trace ML6. The substrate 600 is provided to carry the display driver chip 500 and to communicate the display driver chip 500 to a panel.

Reference is made to FIGS. 4A-4C. After the display driver chip 500 is bonded on the substrate 600, the first pad 530-1 is connected to the first metal trace ML1 through the bump 620, such that the first power input terminal 412 of the first stage 410 of the operational amplifier 400 is connected to the first metal trace ML1. The second pad 530-2 is connected to the second metal trace ML2 through the bump 620, such that the first power input terminal 422 of the second stage 420 of the operational amplifier 400 is connected to the second metal trace ML2 through the bump 620. The third pad 530-3 is connected to the third metal trace ML3 through the bump 620, such that the first power input terminal 432 of the third stage 430 of the operational amplifier 400 is connected to the third metal trace ML3 through the bump 620. The fourth pad 530-4 is connected to the fourth metal trace ML4 through the bump 620, such that the second power input terminal 414 of the first stage 410 of the operational amplifier 400 is connected to the fourth metal trace ML4. The fifth pad 530-5 is connected to the fifth metal trace ML5 through the bump 620, such that the second power input terminal 424 of the second stage 420 of the operational amplifier 400 is connected to the fifth metal trace ML5. The sixth pad 530-6 is connected to the sixth metal trace ML6 through the bump 620, such that the second power input terminal 434 of the third stage 430 of the operational amplifier 400 is connected to the sixth metal trace ML6.

In some embodiments, the first metal trace ML1, the second metal trace ML2, and the third metal trace ML3 are provided with a high voltage level and can be regarded as high voltage lines (VDD1, VDD2, and VDD3). In some embodiments, the fourth metal trace ML4, the fifth metal trace ML5, and the sixth metal trace ML6 are provided with a low voltage level and can be regarded as low voltage lines (VSS1, VSS2, and VSS3). In some embodiments, the voltage between the high voltage level and the low voltage level is positive, and the output terminal 436 outputs positive channel outputs. In some embodiments, the voltage between the high voltage level and the low voltage level is negative, and the output terminal 436 outputs negative channel outputs.

As a result, the first power input terminals 412, 422, and 432 of the operational amplifier 400 are individually provided with the high voltage level (VDD1, VDD2, VDD3), and the second power input terminals 414, 424, and 434 of the operational amplifier 400 are individually provided with the low voltage level (VSS1, VSS2, VSS3). By separating the routing of VDD source and VSS source of the operational amplifier 400, the effect of the voltage variation of VDD source and VSS source due to the slew rate, especially at heavy load, can be reduced, such that the image quality can be improved. More particularly, the VSS source and VDD source of the operational amplifier 400 are separated as VSS1, VSS2, VSS3, VDD1, VDD2, VDD3, and VSS1, VSS2, VSS3, VDD1, VDD2, VDD3 have the corresponding individual pads 530-1 to 530-6 of the display driver chip 500 and the corresponding individual bumps 620 on the substrate 600. Thus the voltage variation of the output stage (e.g. VDD3 and VSS3 of the third stage 430) of the operational amplifier 400, caused by outputting a heavy load image, would not affect the input and gain stage (e.g. VDD1, VDD2, VSS1, and VSS3 of the first and second stage 410, 420) of the operational amplifier 400, and operational amplifier slew rate can be well controlled.

Figure 5B:
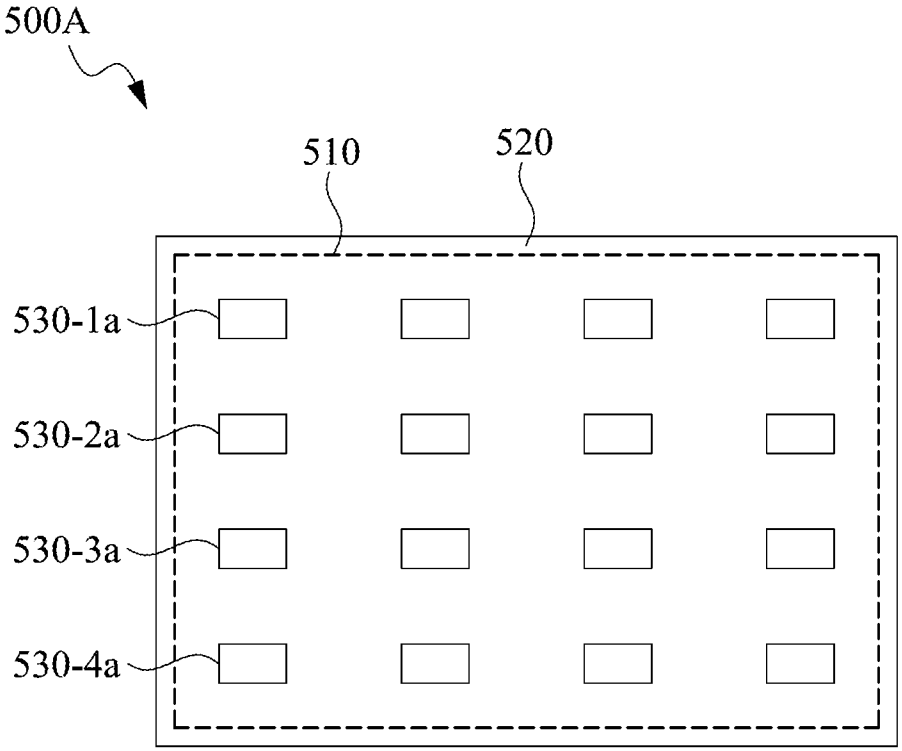
FIG. 5B is a bottom view of a display driver chip having a plurality of operational amplifiers of FIG. 5A.
Figure 5A:
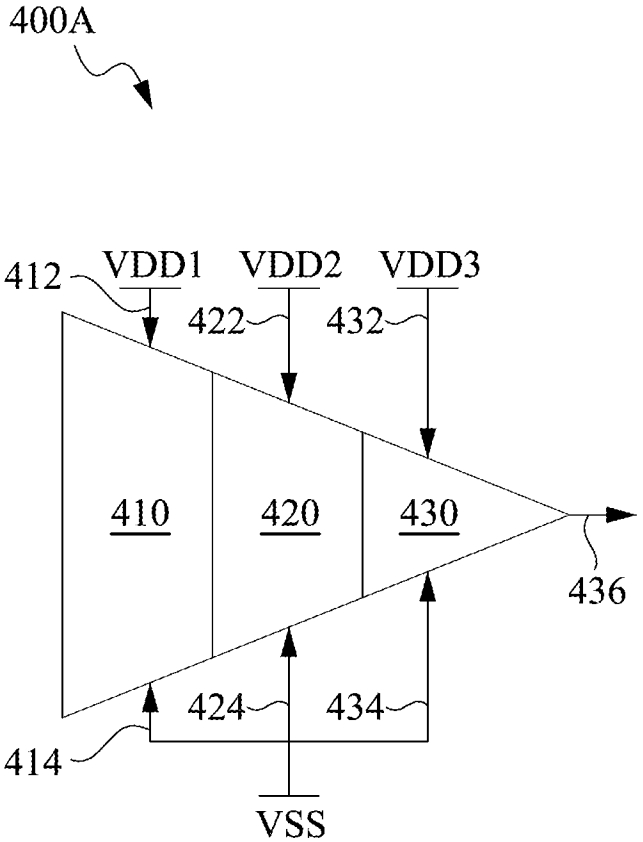
FIG. 5A is a schematic diagram of an operational amplifier according to a fifth embodiment of the present invention.
Figure 5C:
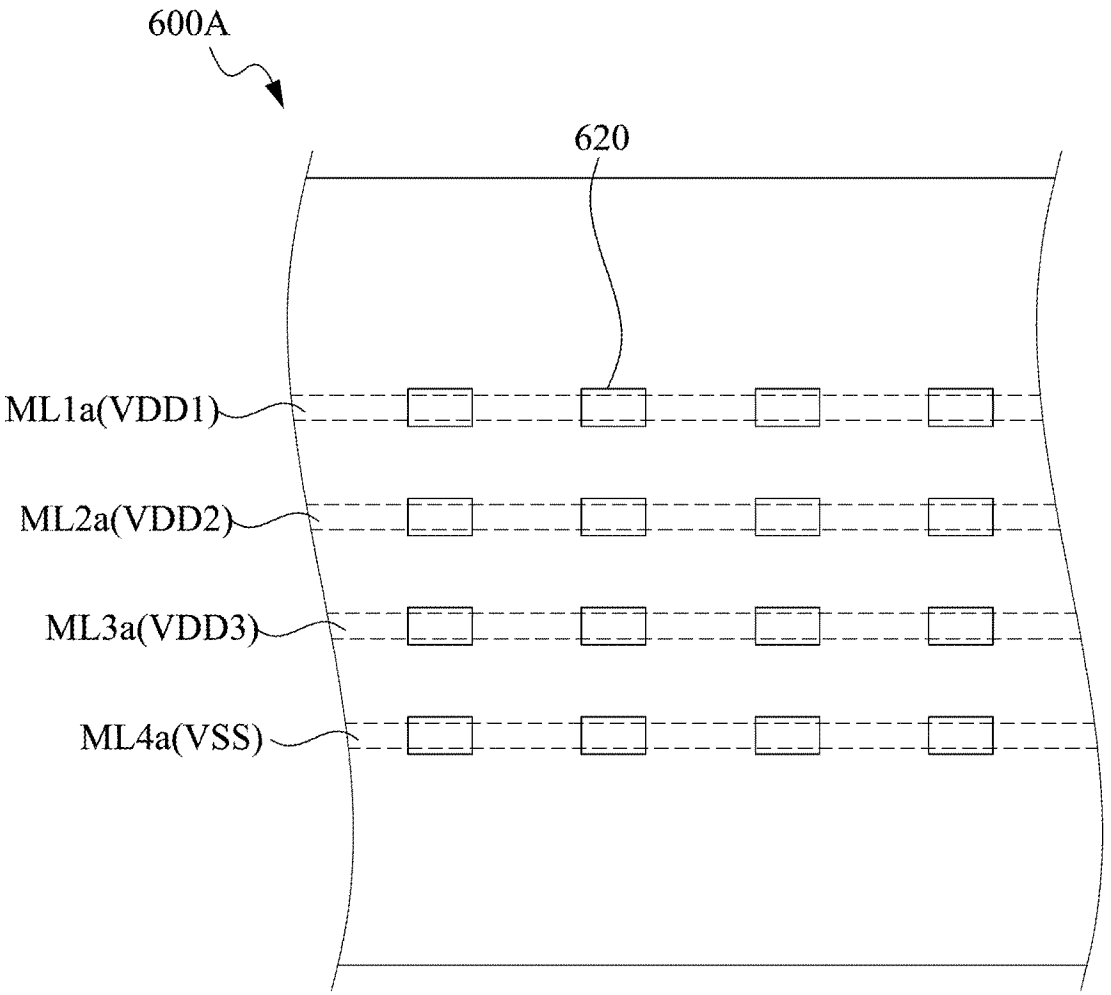
FIG. 5C is a schematic top view of a substrate for carrying and communicating to the display driver chip of FIG. 5B.

Reference is made to FIGS. 5A to 5C, in which FIG. 5A is a schematic diagram of an operational amplifier 400A according to a fifth embodiment of the present invention, FIG. 5B is a bottom view of a display driver chip 500A having a plurality of operational amplifiers 400A of FIG. 5A, and FIG. 5C is a schematic top view of a substrate 600A for carrying and communicating to the display driver chip 500A of FIG. 5B.

One of the differences between the fifth embodiment and the fourth embodiment lies on that the first power input terminals 412, 422, and 432 of the operational amplifier 400A are respectively connected to the pads 530-1*a*, 530-2*a*, and 530-3*a* of the corresponding OP region of the display driver chip 500A, and the second power input terminals 414, 424, and 434 of the operational amplifier 400A are all connected to the pad 530-4*a* of the corresponding OP region of the display driver chip 500A.

Another one of the differences between the fifth embodiment and the fourth embodiment lies on that the pads 530-1*a*, 530-2*a*, and 530-3*a* of the display driver chip 500A are respectively connected to the metal traces ML1*a*, ML2*a*, and ML3*a* of the substrate 600A, which are provided with the high voltage level (VDD1, VDD2, and VDD3), such that the first power input terminals 412, 422, and 432 of the operational amplifier 400A are individually provided with the high voltage levels (VDD1, VDD2, and VDD3). The pad 530-4*a* of the display driver chip 500A is connected to the metal trace ML4*a* of the substrate 600A, which is provided with the low voltage level (VSS), such that the second power input terminals 414, 424, and 434 of the operational amplifier 400A are commonly provided with the low voltage level (VSS). By separating the routing of VDD source of the operational amplifier 400A, the effect of the voltage variation of VDD source due to the slew rate, especially at heavy load, can be reduced, such that the image quality can be improved. More particularly, the VDD source of the operational amplifier 400A is separated as VDD1, VDD2, VDD3, and VDD1, VDD2, VDD3 have the corresponding individual pads 530-1*a* to 530-3*a* of the display driver chip 500A and the corresponding individual bumps 620 on the substrate 600A. Thus the voltage variation of the output stage (e.g. VDD3 of the third stage 430) of the operational amplifier 400A, caused by outputting a heavy load image, would not affect the input and gain stage (e.g. VDD1, VDD2, and VSS of the first and second stage 410, 420) of the operational amplifier 400A, and operational amplifier slew rate can be well controlled.

Figure 6B:
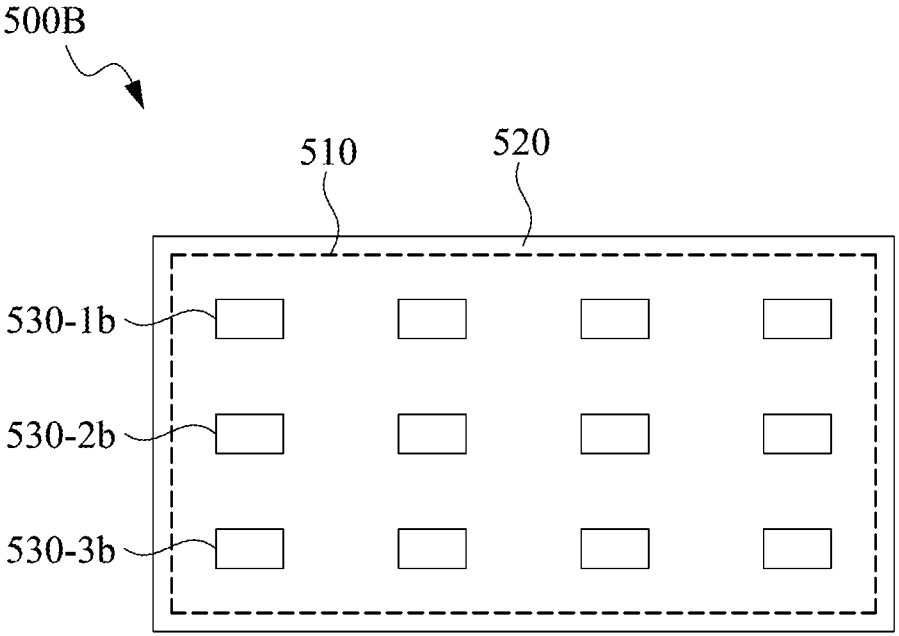
FIG. 6B is a bottom view of a display driver chip having a plurality of operational amplifiers of FIG. 6A.
Figure 6A:
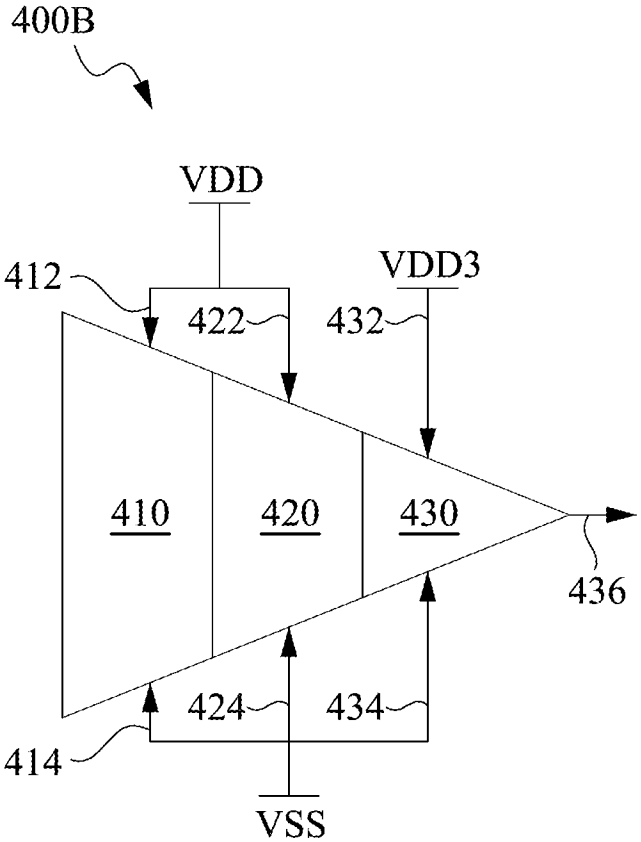
FIG. 6A is a schematic diagram of an operational amplifier according to a sixth embodiment of the present invention.
Figure 6C:
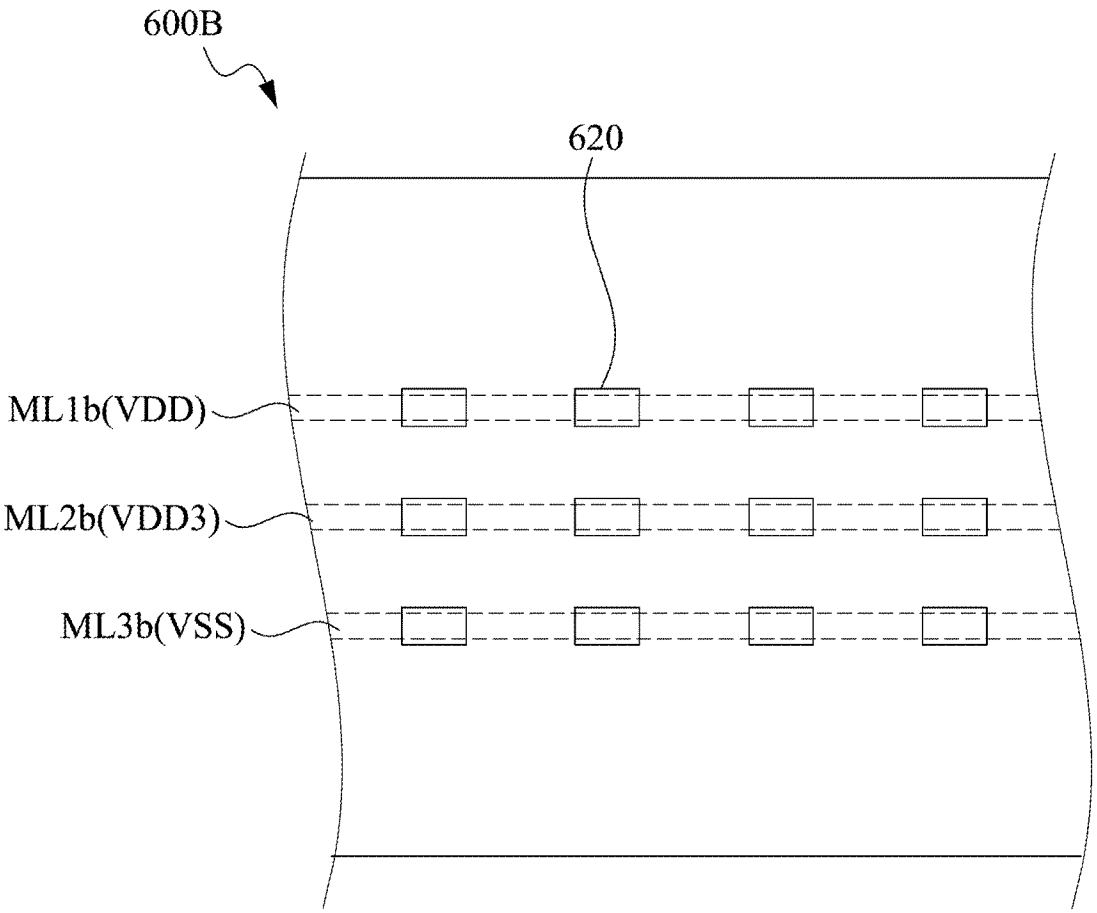
FIG. 6C is a schematic top view of a substrate for carrying and communicating to the display driver chip of FIG. 6B.

Reference is made to FIGS. 6A to 6C, in which FIG. 6A is a schematic diagram of an operational amplifier 400B according to a sixth embodiment of the present invention, FIG. 6B is a bottom view of a display driver chip 500B having a plurality of operational amplifiers 400B of FIG. 6A, and FIG. 6C is a schematic top view of a substrate 600B for carrying and communicating to the display driver chip 500B of FIG. 6B.

One of the differences between the sixth embodiment and the fourth embodiment lies on that the first power input terminals 412 and 422 of the operational amplifier 400B are both connected to the pad 530-1*b* of the corresponding OP region of the display driver chip 500B. The first power input terminal 432 of the operational amplifier 400B is connected to the pad 530-2*b* of the corresponding OP region of the display driver chip 500B. The second power input terminals 414, 424, and 434 of the operational amplifier 400B are all connected to the pad 530-3*b* of the corresponding OP region of the display driver chip 500B.

Another one of the differences between the sixth embodiment and the fourth embodiment lies on that the pad 530-1*b* of the display driver chip 500B is connected to the metal trace ML1*b* of the substrate 600B, which is provided with the high voltage level (VDD), such that the first power input terminals 412 and 422 of the operational amplifier 400B are commonly provided with the high voltage level (VDD). The pad 530-2*b* of the display driver chip 500B is connected to the metal trace ML2*b* of the substrate 600B, which is provided with the high voltage level (VDD3), such that the first power input terminal 432 of the operational amplifier 400B is provided with the high voltage level (VDD3). The pad 530-3*b* of the display driver chip 500B is connected to the metal trace ML3*b* of the substrate 600B, which is provided with the low voltage level (VSS), such that the second power input terminals 414, 424, and 434 of the operational amplifier 400B are commonly provided with the low voltage level (VSS). By separating the routing of VDD source of the operational amplifier 400B, the effect of the voltage variation of VDD source due to the slew rate, especially at heavy load, can be reduced, such that the image quality can be improved. More particularly, the VDD source of the operational amplifier 400B is separated as VDD and VDD3, and VDD and VDD3 have the corresponding individual pads 530-1*b* and 530-2*b* of the display driver chip 500B and the corresponding individual bumps 620 on the substrate 600B. Thus the voltage variation of the output stage (e.g. VDD3 of the third stage 430) of the operational amplifier 400B, caused by outputting a heavy load image, would not affect the input and gain stage (e.g. VDD and VSS of the first and second stage 410, 420) of the operational amplifier 400B, and operational amplifier slew rate can be well controlled.

Figure 7B:
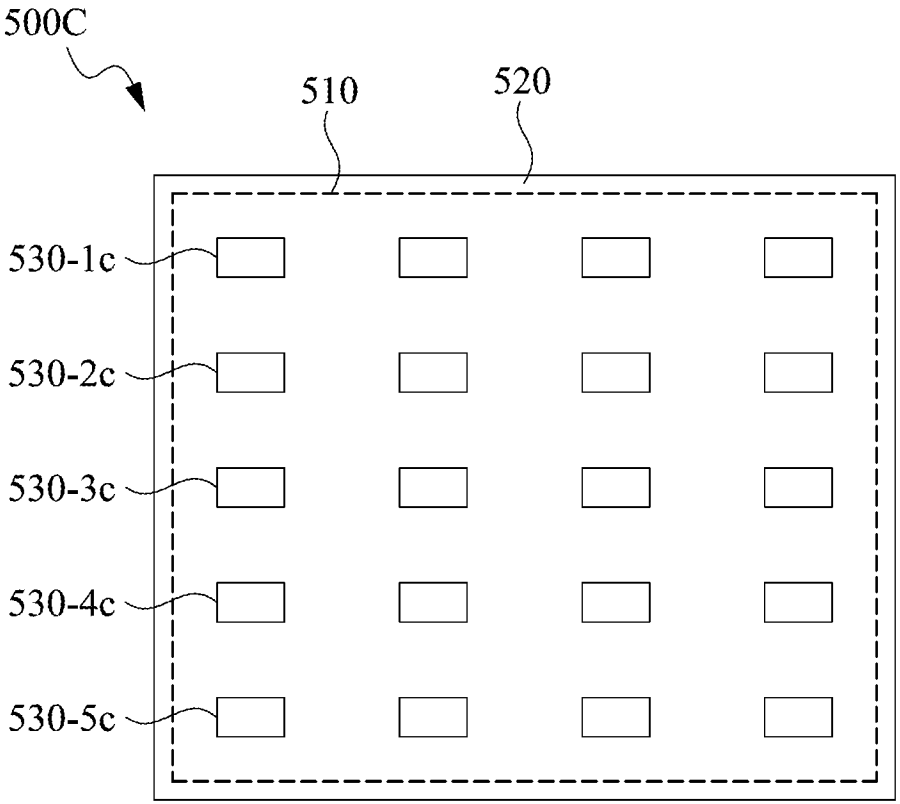
FIG. 7B is a bottom view of a display driver chip having a plurality of operational amplifiers of FIG. 7A.
Figure 7A:
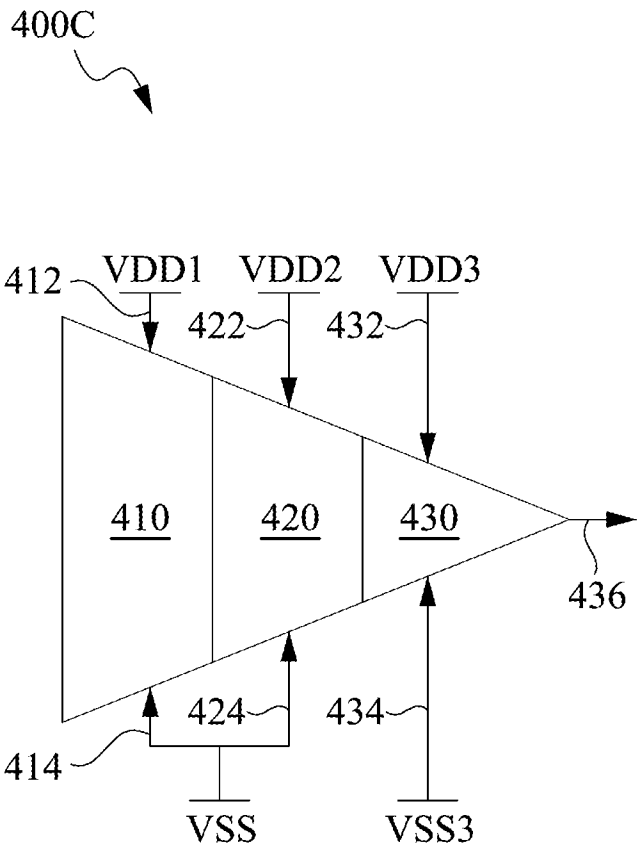
FIG. 7A is a schematic diagram of an operational amplifier according to a seventh embodiment of the present invention.
Figure 7C:
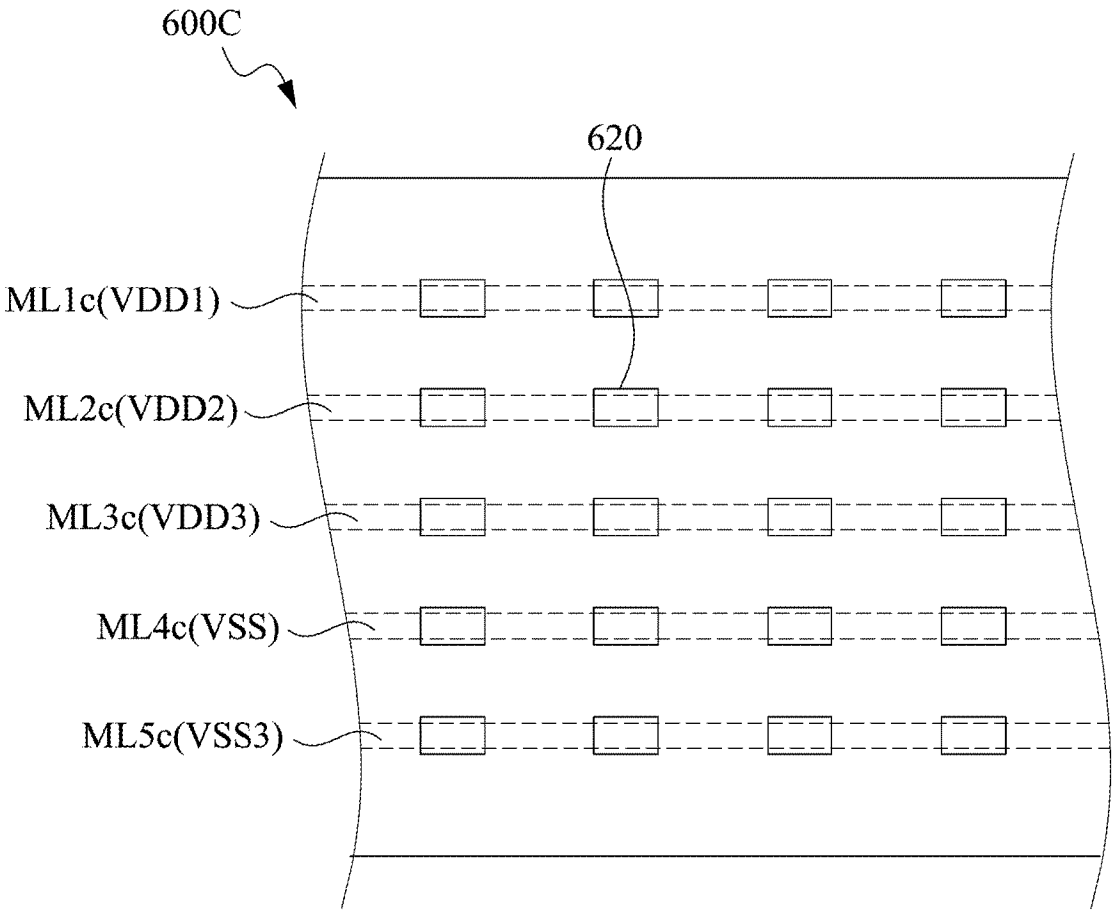
FIG. 7C is a schematic top view of a substrate for carrying and communicating to the display driver chip of FIG. 7B.

Reference is made to FIGS. 7A to 7C, in which FIG. 7A is a schematic diagram of an operational amplifier 400C according to a seventh embodiment of the present invention, FIG. 7B is a bottom view of a display driver chip 500C having a plurality of operational amplifiers 400C of FIG. 7A, and FIG. 7C is a schematic top view of a substrate 600C for carrying and communicating to the display driver chip 500C of FIG. 7B.

One of the differences between the seventh embodiment and the fourth embodiment lies on that the first power input terminals 412, 422, and 432 of the operational amplifier 400C are respectively connected to the pads 530-1*a*, 530-2*a*, and 530-3*c* of the corresponding OP region of the display driver chip 500C. The second power input terminals 414 and 424 of the operational amplifier 400C are both connected to the pad 530-4*c* of the corresponding OP region of the display driver chip 500C. The second power input terminal 434 of the operational amplifier 400C is connected to the pad 530-5*c* of the corresponding OP region of the display driver chip 500C.

Another one of the differences between the seventh embodiment and the fourth embodiment lies on that the pads 530-1*c*, 530-2*c*, and 530-3*c* of the display driver chip 500C are respectively connected to the metal traces ML1*c*, ML2*c*, and ML3*c* of the substrate 600C, which are provided with the high voltage level (VDD1, VDD2, and VDD3), such that the first power input terminals 412, 422, and 432 of the operational amplifier 400C are respectively provided with the high voltage level (VDD1, VDD2, and VDD3). The pad 530-4*c* of the display driver chip 500C is connected to the metal trace ML4*c* of the substrate 600C, which is provided with the low voltage level (VSS), such that the second power input terminals 414 and 424 of the operational amplifier 400C are commonly provided with the low voltage level (VSS). The pad 530-5*c* of the display driver chip 500C is connected to the metal trace ML5*c* of the substrate 600C, which is provided with the low voltage level (VSS3), such that the second power input terminal 434 of the operational amplifier 400C is provided with the low voltage level (VSS3). By separating the routing of VDD source and VSS source of the operational amplifier 400C, the effect of the voltage variation of VDD source and VSS source due to the slew rate, especially at heavy load, can be reduced, such that the image quality can be improved. More particularly, the VSS source and VDD source of the operational amplifier 400C are separated as VSS, VSS3, VDD1, VDD2, VDD3, and VSS, VSS3, VDD1, VDD2, VDD3 have the corresponding individual pads 530-1*c* to 530-5*c* of the display driver chip 500C and the corresponding individual bumps 620 on the substrate 600C. Thus the voltage variation of the of output stage (e.g. VDD3 and VSS3 of the third stage 430) of the operational amplifier 400C, caused by outputting a heavy load image, would not affect the input and gain stage (e.g. VSS, VDD1, VDD2 of the first and second stage 410, 420) of the operational amplifier 400C, and operational amplifier slew rate can be well controlled.

Figure 8B:
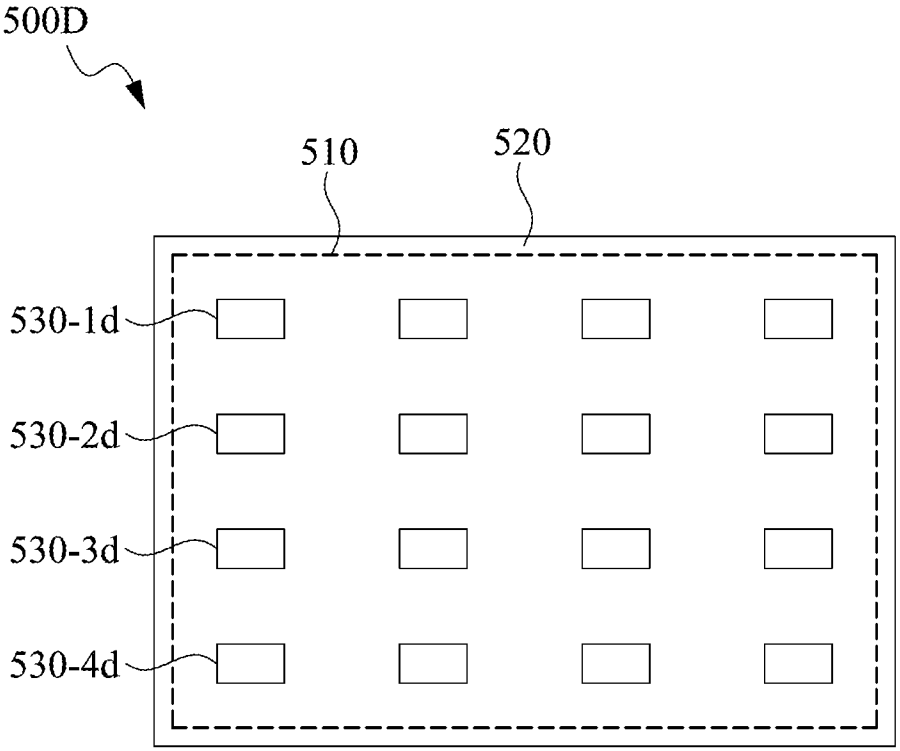
FIG. 8B is a bottom view of a display driver chip having a plurality of operational amplifiers of FIG. 8A.
Figure 8A:
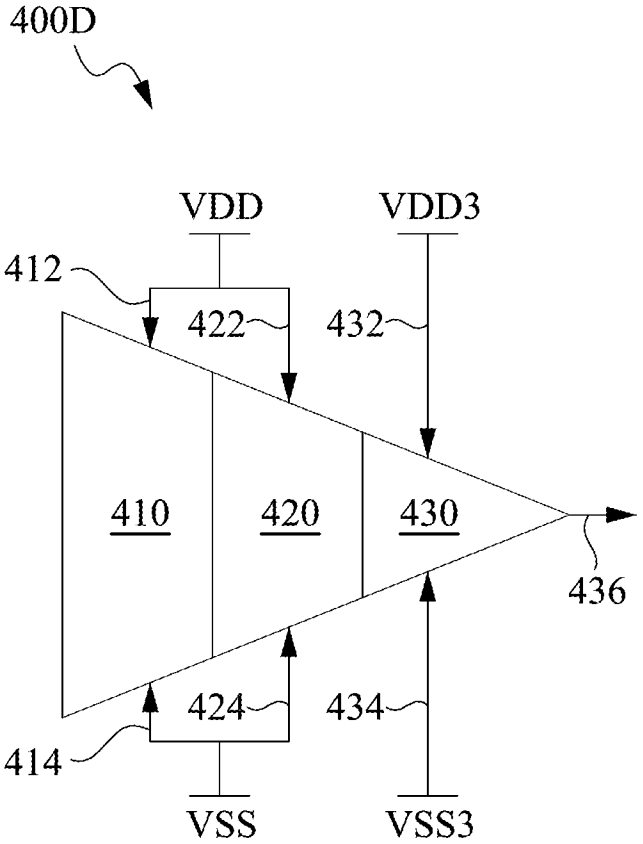
FIG. 8A is a schematic diagram of an operational amplifier according to an eighth embodiment of the present invention.
Figure 8C:
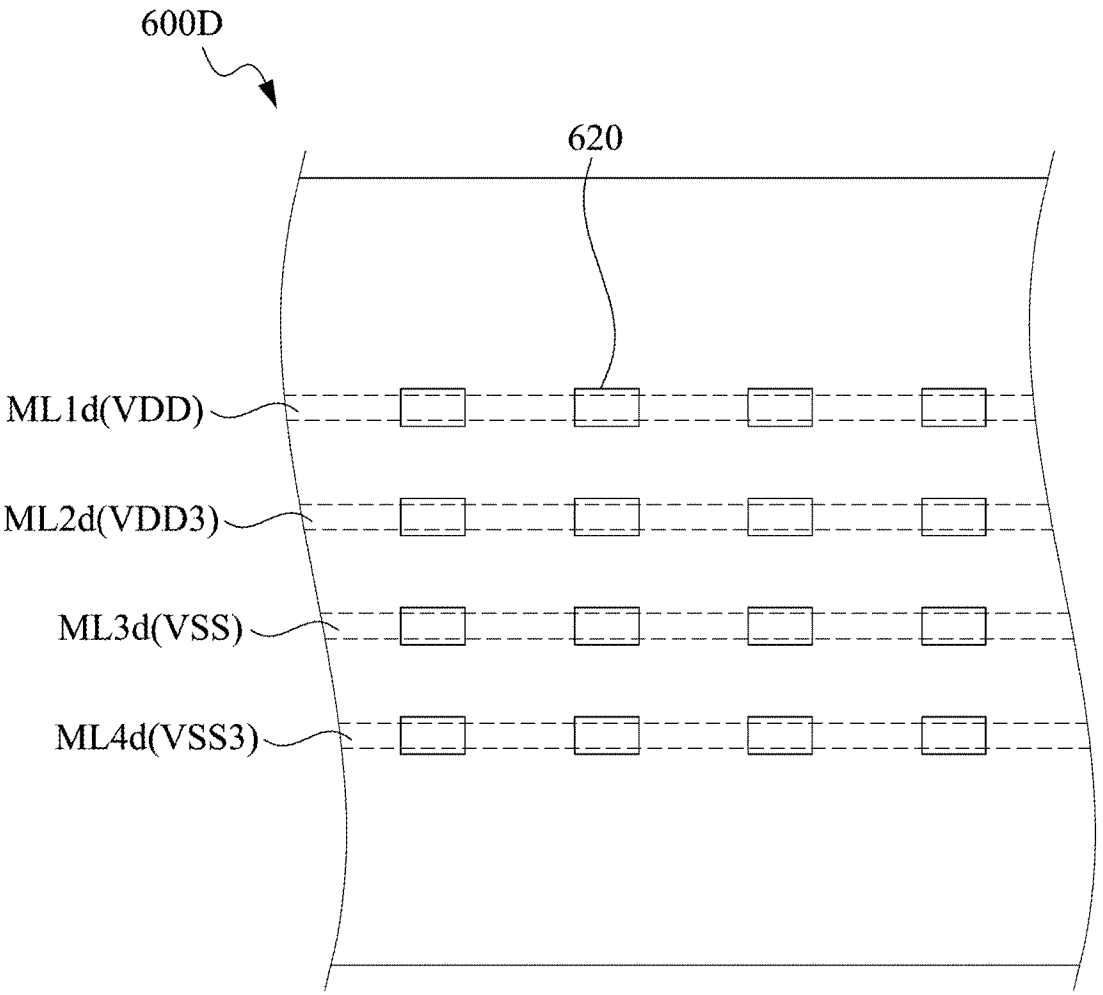
FIG. 8C is a schematic top view of a substrate for carrying and communicating to the display driver chip of FIG. 8B.

Reference is made to FIGS. 8A to 8C, in which FIG. 8A is a schematic diagram of an operational amplifier 400D according to an eighth embodiment of the present invention, FIG. 8B is a bottom view of a display driver chip 500D having a plurality of operational amplifiers 400D of FIG. 8A, and FIG. 8C is a schematic top view of a substrate 600D for carrying and communicating to the display driver chip 500D of FIG. 8B.

One of the differences between the eighth embodiment and the fourth embodiment lies on that the first power input terminals 412 and 422 of the operational amplifier 400D are both connected to the pad 530-1*d* of the corresponding OP region of the display driver chip 500D. The first power input terminal 432 of the operational amplifier 400D is connected to the pad 530-2*d* of the corresponding OP region of the display driver chip 500D. The second power input terminals 414 and 424 of the operational amplifier 400D are both connected to the pad 530-3*d* of the corresponding OP region of the display driver chip 500D. The second power input terminal 434 of the operational amplifier 400D is connected to the pad 530-4*d* of the corresponding OP region of the display driver chip 500D.

Another one of the differences between the eighth embodiment and the fourth embodiment lies on that the pad 530-1*d* of the display driver chip 500D is connected to the metal trace ML1*d* of the substrate 600B, which is provided with the high voltage level (VDD), such that the first power input terminals 412 and 422 of the operational amplifier 400D are commonly provided with the high voltage level (VDD). The pad 530-2*d* of the display driver chip 500D is connected to the metal trace ML2*d* of the substrate 600D, which is provided with the high voltage level (VDD3), such that the first power input terminal 432 of the operational amplifier 400D is provided with the high voltage level (VDD3). The pad 530-3*d* of the display driver chip 500D is connected to the metal trace ML3*d* of the substrate 600D, which is provided with the low voltage level (VSS), such that the second power input terminals 414 and 424 of the operational amplifier 400D are commonly provided with the low voltage level (VSS). The pad 530-4*d* of the display driver chip 500D is connected to the metal trace ML4*d* of the substrate 600D, which is provided with the low voltage level (VSS3), such that the second power input terminal 434 of the operational amplifier 400D is provided with the low voltage level (VSS3). By separating the routing of VDD source and VSS source of the operational amplifier 400D, the effect of the voltage variation of VDD source and VSS source due to the slew rate, especially at heavy load, can be reduced, such that the image quality can be improved. More particularly, the VSS source and VDD source of the operational amplifier 400D are separated as VSS, VSS3, VDD, VDD3, and VSS, VSS3, VDD, VDD3 have the corresponding individual pads 530-1*d* to 530-4*d* of the display driver chip 500D and the corresponding individual bumps 620 on the substrate 600D. Thus the voltage variation of the output stage (e.g. VDD3 and VSS3 of the third stage 430) of the operational amplifier 400D, caused by outputting a heavy load image, would not affect the input and gain stage (e.g. VDD and VSS of the first and second stage 410, 420) of the operational amplifier 400D, and operational amplifier slew rate can be well controlled.

Figure 9B:
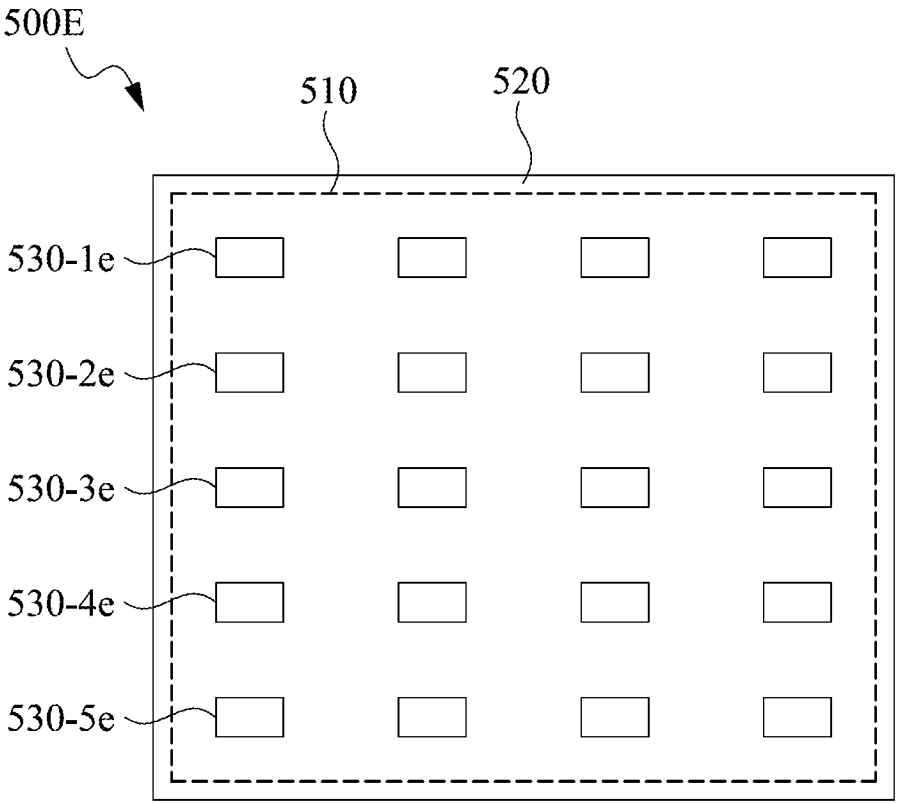
FIG. 9B is a bottom view of a display driver chip having a plurality of operational amplifiers of FIG. 9A.
Figure 9A:
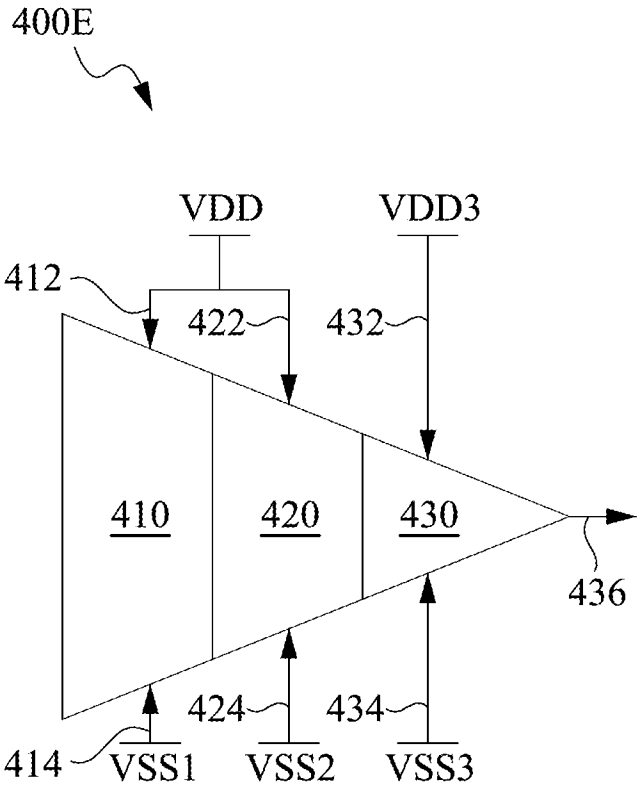
FIG. 9A is a schematic diagram of an operational amplifier according to a ninth embodiment of the present invention.
Figure 9C:
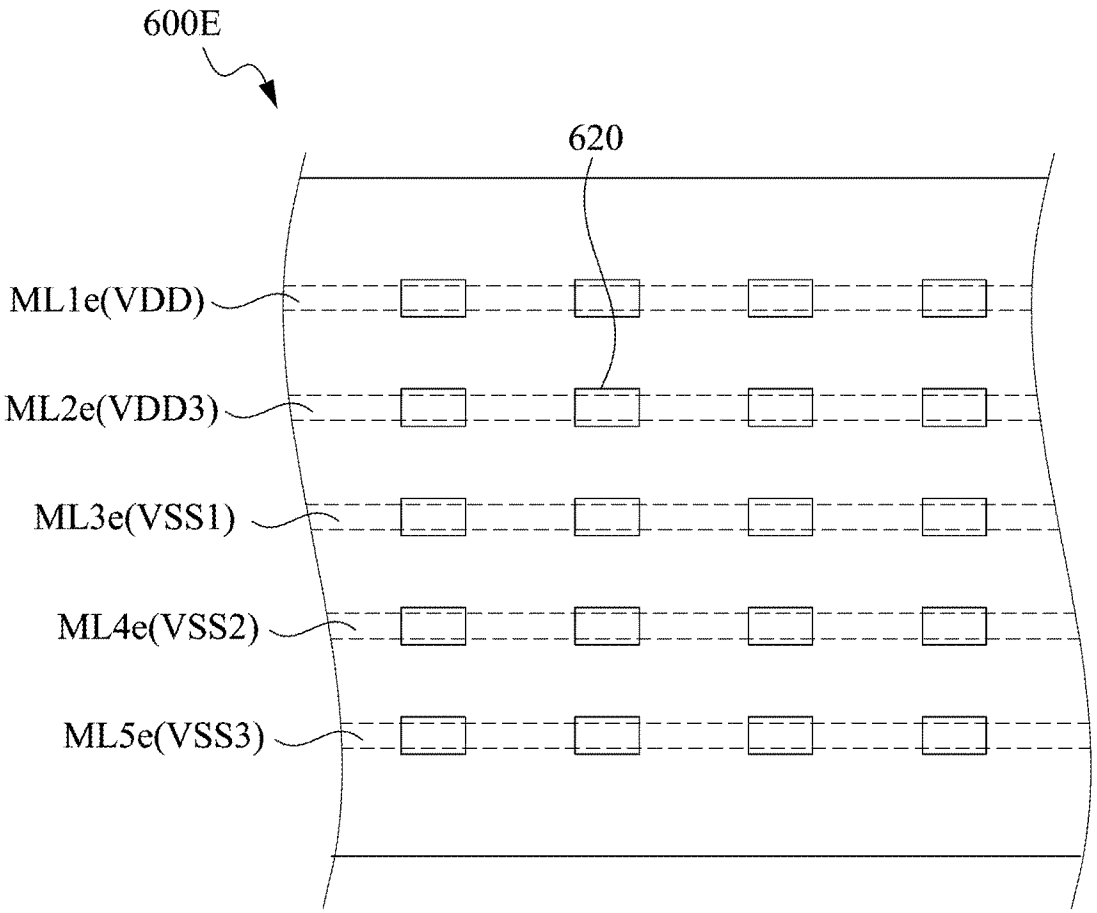
FIG. 9C is a schematic top view of a substrate for carrying and communicating to the display driver chip of FIG. 9B.

Reference is made to FIGS. 9A to 9C, in which FIG. 9A is a schematic diagram of an operational amplifier 400E according to a ninth embodiment of the present invention, FIG. 9B is a bottom view of a display driver chip 500E having a plurality of operational amplifiers 400E of FIG. 9A, and FIG. 9C is a schematic top view of a substrate 600E for carrying and communicating to the display driver chip 500E of FIG. 9B.

One of the differences between the ninth embodiment and the fourth embodiment lies on that the first power input terminals 412 and 422 of the operational amplifier 400E are both connected to the pad 530-1*e* of the corresponding OP region of the display driver chip 500E. The first power input terminal 432 of the operational amplifier 400E is connected to the pad 530-2*e* of the corresponding OP region of the display driver chip 500E. The second power input terminals 414, 424 and 434 of the operational amplifier 400E are respectively connected to the pads 530-3*e*, 530-4*e*, and 530-5*e* of the corresponding OP region of the display driver chip 500E.

Another one of the differences between the ninth embodiment and the fourth embodiment lies on that the pad 530-1*e* of the display driver chip 500E is connected to the metal trace ML1*e* of the substrate 600E, which is provided with the high voltage level (VDD), such that the first power input terminals 412 and 422 of the operational amplifier 400E are commonly provided with the high voltage level (VDD). The pad 530-2*e* of the display driver chip 500E is connected to the metal trace ML2*e* of the substrate 600E, which is provided with the high voltage level (VDD3), such that the first power input terminal 432 of the operational amplifier 400E is provided with the high voltage level (VDD3). The pads 530-3*e*, 530-4*e*, and 530-5*e* of the display driver chip 500E are respectively connected to the metal traces ML3*e*, ML4*e*, and ML5*e* of the substrate 600E, which are provided with the low voltage level (VSS1, VSS2, VSS3), such that the second power input terminals 414, 424, and 434 of the operational amplifier 400E are respectively provided with the low voltage level (VSS1, VSS2, VSS3). By separating the routing of VDD source and VSS source of the operational amplifier 400E, the effect of the voltage variation of VDD source and VSS source due to the slew rate, especially at heavy load, can be reduced, such that the image quality can be improved. More particularly, the VSS source and VDD source of the operational amplifier 400E are separated as VSS1, VSS2, VSS3, VDD, VDD3, and VSS1, VSS2, VSS3, VDD, VDD3 have the corresponding individual pads 530-1*e* to 530-5*e* of the display driver chip 500E and the corresponding individual bumps 620 on the substrate 600E. Thus the voltage variation of the output stage (e.g. VDD3 and VSS3 of the third stage 430) of the operational amplifier 400E, caused by outputting a heavy load image, would not affect the input and gain stage (e.g. VSS1, VSS2, VDD and VSS of the first and second stage 410, 420) of the operational amplifier 400E, and operational amplifier slew rate can be well controlled.

Figure 10B:
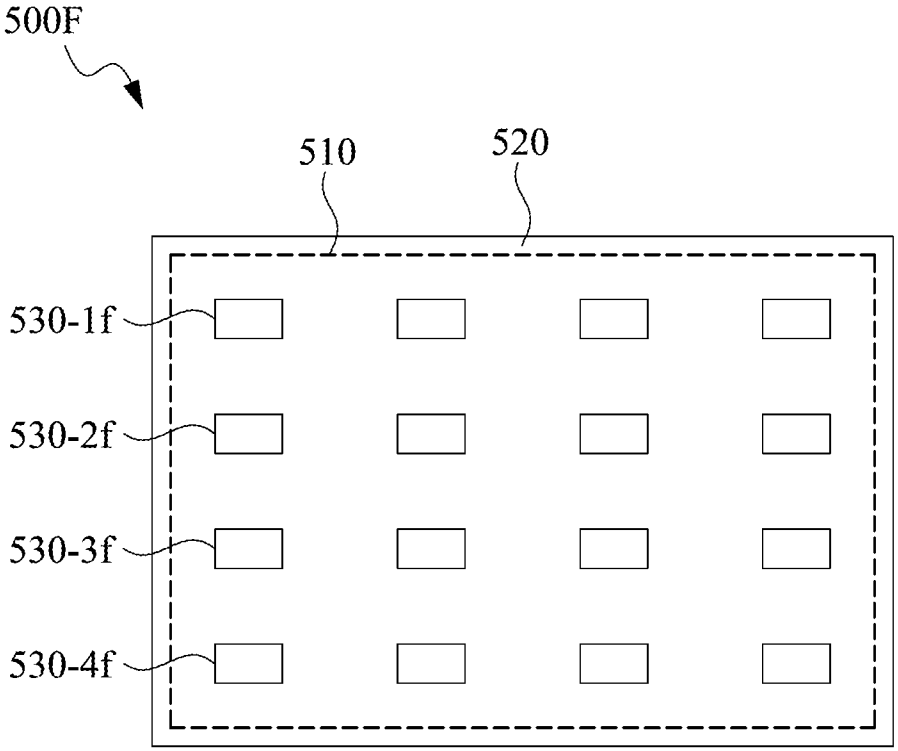
FIG. 10B is a bottom view of a display driver chip having a plurality of operational amplifiers of FIG. 10A.
Figure 10A:
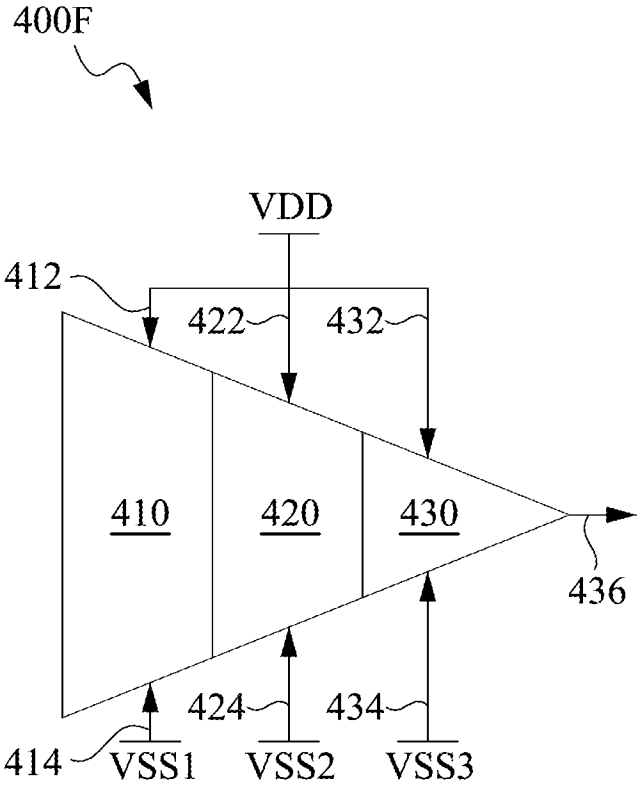
FIG. 10A is a schematic diagram of an operational amplifier according to a tenth embodiment of the present invention.
Figure 10C:
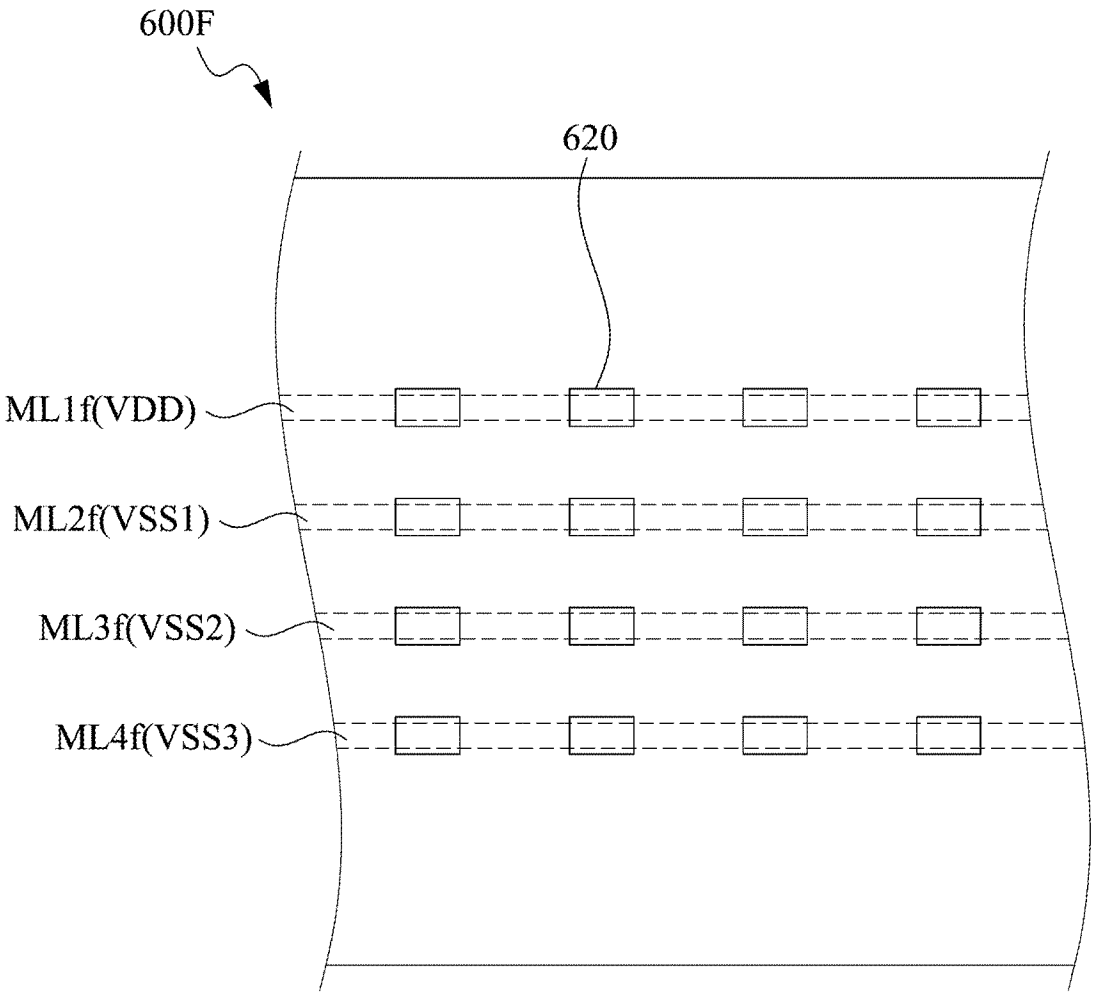
FIG. 10C is a schematic top view of a substrate for carrying and communicating to the display driver chip of FIG. 10B.

Reference is made to FIGS. 10A to 10C, in which FIG. 10A is a schematic diagram of an operational amplifier 400F according to a tenth embodiment of the present invention, FIG. 10B is a bottom view of a display driver chip 500F having a plurality of operational amplifiers 400F of FIG. 10A, and FIG. 10C is a schematic top view of a substrate 600F for carrying and communicating to the display driver chip 500F of FIG. 10B.

One of the differences between the tenth embodiment and the fourth embodiment lies on that the first power input terminals 412, 422, and 432 of the operational amplifier 400F are all connected to the pad 530-1*f* of the corresponding OP region of the display driver chip 500F. The second power input terminals 414, 424 and 434 of the operational amplifier 400E are respectively connected to the pads 530-2*f*, 530-3*f*, and 530-4*f* of the corresponding OP region of the display driver chip 500F.

Another one of the differences between the tenth embodiment and the fourth embodiment lies on that the pad 530-1*f* of the display driver chip 500F is connected to the metal trace ML1*f* of the substrate 600F, which is provided with the high voltage level (VDD), such that the first power input terminals 412, 422, and 432 of the operational amplifier 400F are commonly provided with the high voltage level (VDD). The pads 530-2*f*, 530-3*f*, and 530-4*f* of the display driver chip 500F are respectively connected to the metal traces ML2*f*, ML3*f*, and ML4*f* of the substrate 600F, which are provided with the low voltage level (VSS1, VSS2, VSS3), such that the second power input terminals 414, 424, and 434 of the operational amplifier 400F are respectively provided with the low voltage level (VSS1, VSS2, VSS3). By separating the routing of VSS source of the operational amplifier 400F, the effect of the voltage variation of VSS source due to the slew rate, especially at heavy load, can be reduced, such that the image quality can be improved. More particularly, the VSS source of the operational amplifier 400F is separated as VSS1, VSS2, VSS3, and VSS1, VSS2, VSS3 have the corresponding individual pads 530-2*f* to 530-4*f* of the display driver chip 500F and the corresponding individual bumps 620 on the substrate 600F. Thus the voltage variation of the output stage (e.g. VSS3 of the third stage 430) of the operational amplifier 400F, caused by outputting a heavy load image, would not affect the input and gain stage (e.g. VSS1, VSS2, and VDD of the first and second stage 410, 420) of the operational amplifier 400F, and operational amplifier slew rate can be well controlled.

Figure 11B:
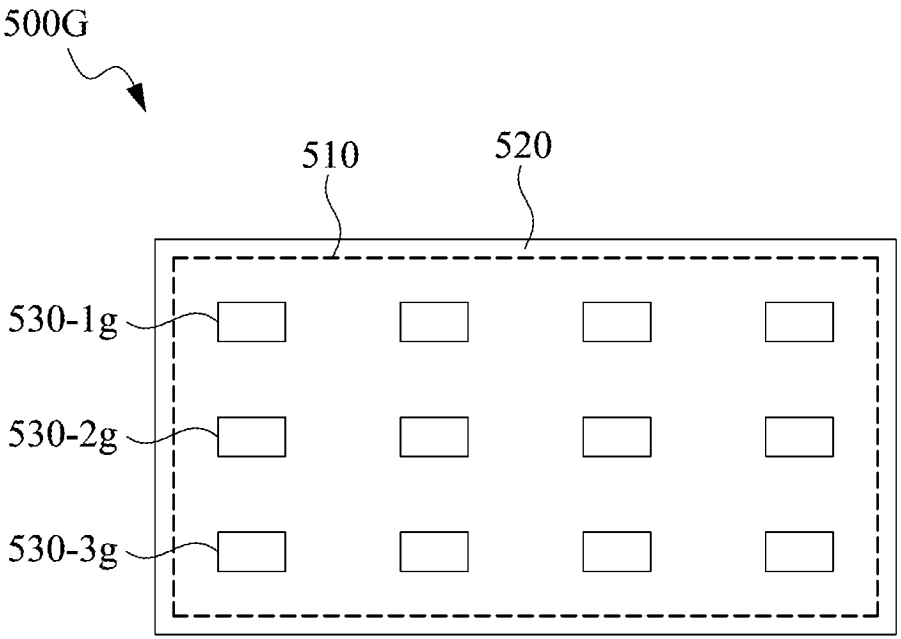
FIG. 11B is a bottom view of a display driver chip having a plurality of operational amplifiers of FIG. 11A.
Figure 11A:
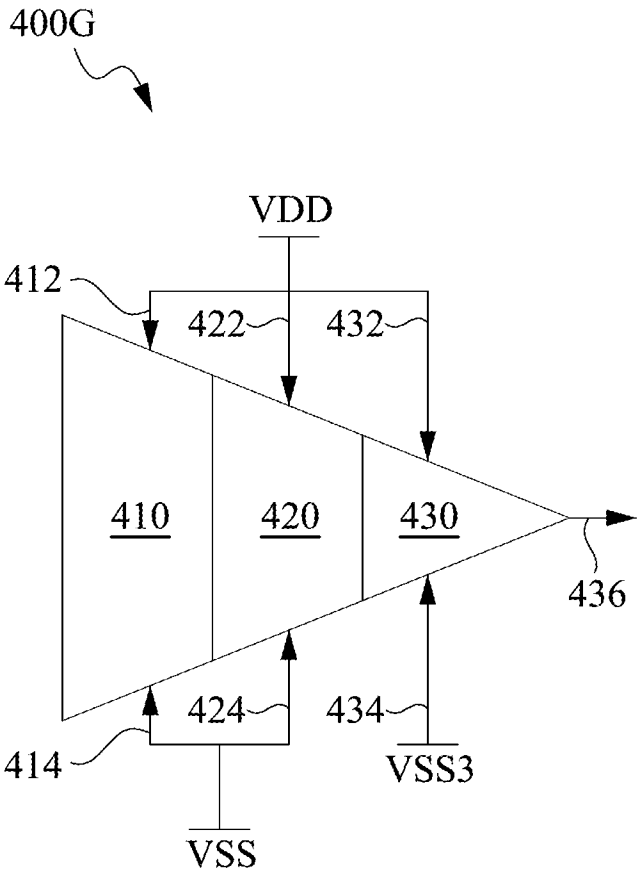
FIG. 11A is a schematic diagram of an operational amplifier according to an eleventh embodiment of the present invention.
Figure 11C:
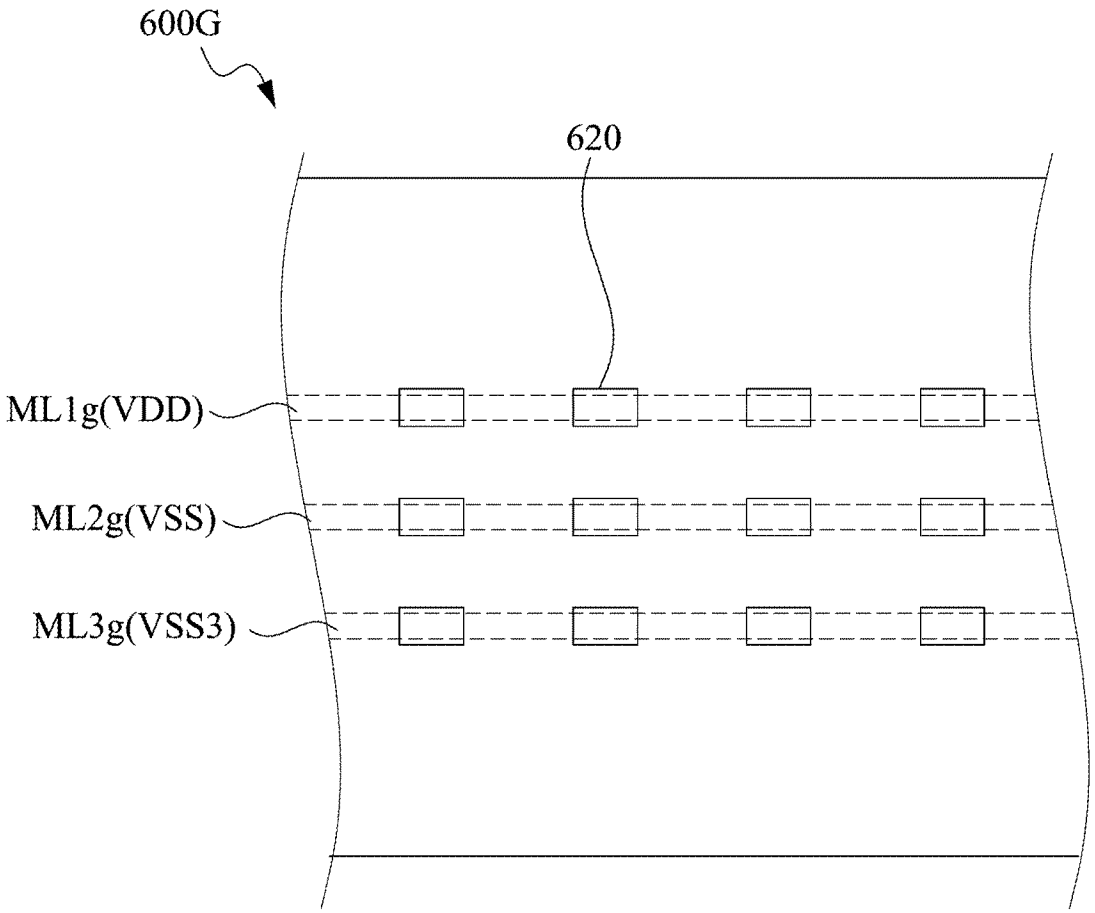
FIG. 11C is a schematic top view of a substrate for carrying and communicating to the display driver chip of FIG. 11B.

Reference is made to FIGS. 11A to 11C, in which FIG. 11A is a schematic diagram of an operational amplifier 400G according to an eleventh embodiment of the present invention, FIG. 11B is a bottom view of a display driver chip 500G having a plurality of operational amplifiers 400G of FIG. 11A, and FIG. 11C is a schematic top view of a substrate 600G for carrying and communicating to the display driver chip 500G of FIG. 11B.

One of the differences between the eleventh embodiment and the fourth embodiment lies on that the first power input terminals 412, 422, and 432 of the operational amplifier 400G are all connected to the pad 530-1*g* of the corresponding OP region of the display driver chip 500G. The second power input terminals 414 and 424 of the operational amplifier 400G are both connected to the pad 530-2*g* of the corresponding OP region of the display driver chip 500G. The second power input terminal 434 of the operational amplifier 400G is connected to the pad 530-3*g* of the corresponding OP region of the display driver chip 500G.

Another one of the differences between the eleventh embodiment and the fourth embodiment lies on that the pad 530-1*g* of the display driver chip 500G is connected to the metal trace ML1*g* of the substrate 600G, which is provided with the high voltage level (VDD), such that the first power input terminals 412, 422, and 432 of the operational amplifier 400G are commonly provided with the high voltage level (VDD). The pad 530-2*g* of the display driver chip 500G is connected to the metal trace ML2*g*, which is provided with the low voltage level (VSS), such that the second power input terminals 414 and 424 of the operational amplifier 400G are commonly provided with the low voltage level (VSS). The pad 530-3*g* of the display driver chip 500G is connected to the metal trace ML3*g*, which is provided with the low voltage level (VSS3), such that the second power input terminal 434 of the operational amplifier 400G is provided with the low voltage level (VSS3). By separating the routing of VSS source of the operational amplifier 400G, the effect of the voltage variation of VSS source due to the slew rate, especially at heavy load, can be reduced, such that the image quality can be improved. More particularly, the VSS source of the operational amplifier 400G is separated as VSS and VSS3, and VSS and VSS3 have the corresponding individual pads 530-2*g* and 530-3*g* of the display driver chip 500G and the corresponding individual bumps 620 on the substrate 600G. Thus the voltage variation of the output stage (e.g. VSS3 of the third stage 430) of the operational amplifier 400G, caused by outputting a heavy load image, would not affect the input and gain stage (e.g. VSS and VDD of the first and second stage 410, 420) of the operational amplifier 400G, and operational amplifier slew rate can be well controlled.

Figure 12:
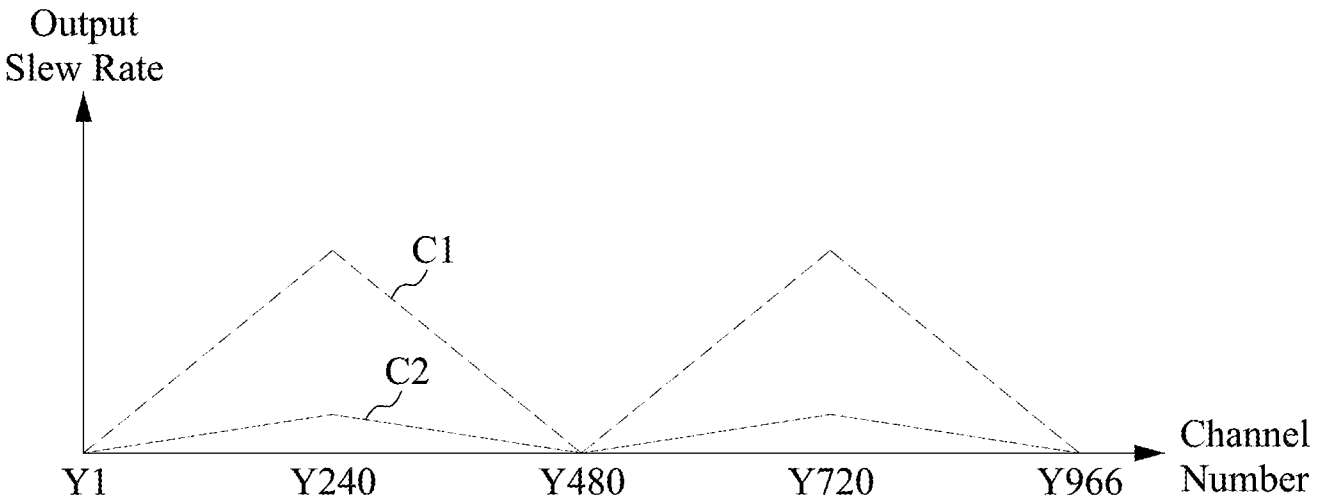
FIG. 12 is a graph that shows an improvement of the disclosure.

Please refer to FIG. 12, as discussed above, by separating the routing of VSS source and/or VDD source of the output stage of the operational amplifier, the operational amplifier slew rate can be well controlled. For example, the curve C1 is a slew rate of an embodiment with common VSS source to all three stages and common VDD source to all three stages, and the curve C2 is a slew rate of the embodiment of FIG. 4A, with VSS1, VSS2, and VSS3 to input, gain, and output stages, and VDD1, VDD2, and VDD3 to input, gain, and output stages, respectively. The curve C2 is more concentrate than the curve C1, which means the output slew rate of operational amplifier with separated VSS source and/or VDD source is well controlled.

Figure 13:
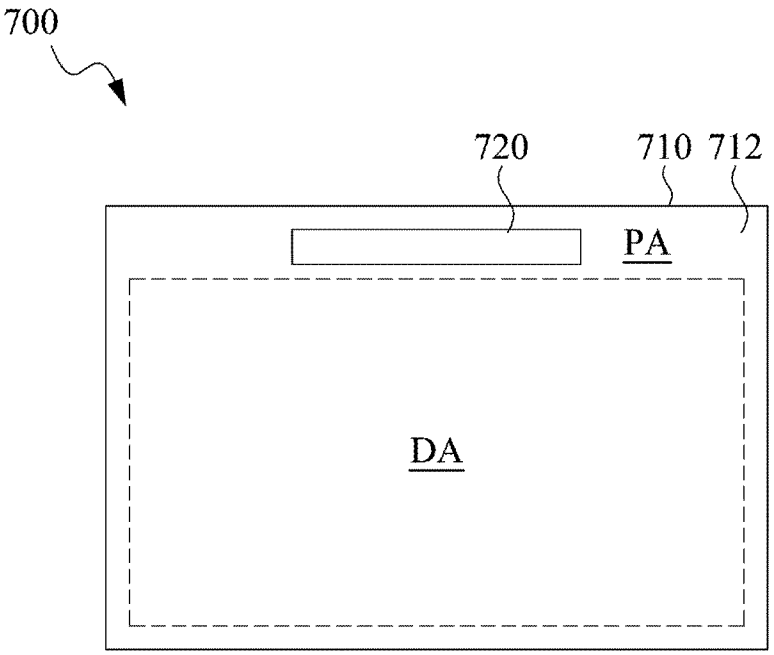
FIG. 13 is a schematic view of an electronic device according to some embodiments of the invention.

Reference is now made to FIG. 13. FIG. 13 is a schematic view of an electronic device according to some embodiments of the invention. The electronic device 700 includes a display panel 710, in which the display panel 710 has an array substrate 712 having a display area DA and a peripheral area PA. The display area DA has a pixel array. A display driver chip 720 of the electronic device 700 is bonded on the peripheral area PA of the array substrate 712 of the display panel 710. The display driver chip 720 is connected to the pixel array of the display area DA through the metal traces that are disposed on the peripheral area PA. The display driver chip 720 can be any one of the display driver chips as discussed in the first embodiment to the eleventh embodiment. The array substrate 712 of the display panel 710 can be a glass substrate, such that the electronic device 700 can be regarded as a chip on glass (COG) display.

Figure 14:
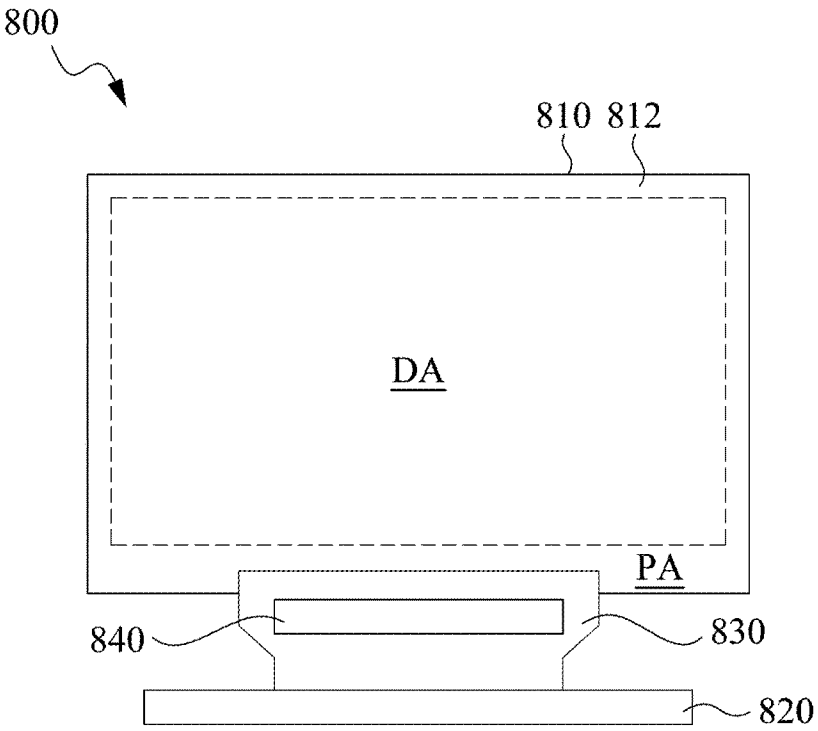
FIG. 14 is a schematic view of an electronic device according to some other embodiments of the invention.

Reference is now made to FIG. 14. FIG. 14 is a schematic view of an electronic device according to some other embodiments of the invention. The electronic device 800 includes a display panel 810, a control board 820, and a flexible substrate 830 connecting the display panel 810 to the control board 820. The display panel 810 has an array substrate 812 having a display area DA and a peripheral area PA. The display area DA has a pixel array. A display driver chip 840 of the electronic device 800 is disposed on the flexible substrate 830, such that the signals form the control board 820 can be transmitted to the display panel 810 through the flexible substrate 830 and the display driver chip 840. The display driver chip 840 can be any one of the display driver chips as discussed in the first embodiment to the eleventh embodiment. The flexible substrate 830 can be a film having circuits thereon, such that the electronic device 800 can be regarded as a chip on film (COF) display.

By separating the routing of VDD source and/or VSS source of the operational amplifier, the effect of the voltage variation of VDD source and/or VSS source to the operational amplifier slew rate, especially at heavy load, can be reduced, such that the image quality can be improved. More particularly, VDD source and/or VSS source of output stage of the operational amplifier are separated and have the corresponding individual pads of the chip and the corresponding individual bumps on the substrate. Thus the voltage variation of VDD source and/or VSS source of output stage of the operational amplifier, caused by outputting a heavy load image, would not affect VDD source and/or VSS source of input and/or gain stage of the operational amplifier, and operational amplifier slew rate can be well controlled.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a substrate; and a display driver chip bonded on the substrate and comprising a plurality of operational amplifiers, each of the operational amplifiers comprising a first stage and a second stage, wherein the first stage comprises a first power input terminal;

the second stage comprises a first power input terminal and an output terminal for outputting an output voltage;

the first power input terminal of the first stage is connected to a first metal trace of the substrate;

the first power input terminal of the second stage is connected to a second metal trace of the substrate; and the first power input terminal of the first stage and the first power input terminal of the second stage are both provided with a first voltage level.

2. The electronic device of claim 1, wherein the first metal trace and the second metal trace are high voltage lines.

3. The electronic device of claim 1, wherein the first metal trace and the second metal trace are low voltage lines.

4. The electronic device of claim 1, wherein the first stage comprises a second power input terminal;

the second stage comprises a second power input terminal;

the second power input terminal of the first stage and the second power input terminal of the second stage are both connected to a third metal trace of the substrate; and the second power input terminal of the first stage and the second power input terminal of the second stage are both provided with a second voltage level that is different from the first voltage level.

5. The electronic device of claim 1, wherein the first stage comprises a second power input terminal;

the second power input terminal of the first stage is connected to a third metal trace of the substrate;

the second stage comprises a second power input terminal;

the second power input terminal of the second stage is connected to a fourth metal trace of the substrate; and the second power input terminal of the first stage and the second power input terminal of the second stage are both provided with a second voltage level that is different from the first voltage level.

6. The electronic device of claim 1, wherein each of the operational amplifiers comprises a third stage coupled to the first stage or between the first stage and the second stage, wherein the third stage comprises a first power input terminal;

the first power input terminal of the third stage is connected to a third metal trace of the substrate; and the first power input terminal of the third stage is provided with the first voltage level.

7. The electronic device of claim 6, wherein the first stage comprises a second power input terminal;

the second stage comprises a second power input terminal;

the third stage comprises a second power input terminal;

the second power input terminal of the first stage, the second power input terminal of the second stage, and the second power input terminal of the third stage are all connected to a fourth metal trace of the substrate; and the second power input terminal of the first stage, the second power input terminal of the second stage, and the second power input terminal of the third stage are all provided with a second voltage level that is different from the first voltage level.

8. The electronic device of claim 6, wherein the first stage comprises a second power input terminal;

the third stage comprises a second power input terminal;

the second power input terminal of the first stage and the second power input terminal of the third stage are both connected to a fourth metal trace of the substrate;

the second stage comprises a second power input terminal;

the second power input terminal of the second stage is connected to a fifth metal trace of the substrate; and the second power input terminal of the first stage, the second power input terminal of the second stage, and the second power input terminal of the third stage are all provided with a second voltage level that is different from the first voltage level.

9. The electronic device of claim 6, wherein the first stage comprises a second power input terminal;

the second power input terminal of the first stage is connected to a fourth metal trace of the substrate;

the second stage comprises a second power input terminal;

the second power input terminal of the second stage is connected to a fifth metal trace of the substrate;

the third stage comprises a second power input terminal;

the second power input terminal of the third stage is connected to a sixth metal trace of the substrate; and the second power input terminal of the first stage, the second power input terminal of the second stage, and the second power input terminal of the third stage are all provided with a second voltage level that is different from the first voltage level.

10. The electronic device of claim 1, wherein each of the operational amplifiers comprises a third stage coupled to the first stage or between the first stage and the second stage, wherein the third stage comprises a first power input terminal;

the first power input terminal of the third stage is connected to the first metal trace of the substrate; and the first power input terminal of the third stage is provided with the first voltage level.

11. The electronic device of claim 10, wherein the first stage comprises a second power input terminal;

the second stage comprises a second power input terminal;

the third stage comprises a second power input terminal;

the second power input terminal of the first stage, the second power input terminal of the second stage, and the second power input terminal of the third stage are all connected to a third metal trace of the substrate; and the second power input terminal of the first stage, the second power input terminal of the second stage, and the second power input terminal of the third stage are all provided with a second voltage level that is different from the first voltage level.

12. The electronic device of claim 10, wherein the first stage comprises a second power input terminal;

the second power input terminal of the first stage is connected to a third metal trace of the substrate;

the second stage comprises a second power input terminal;

the second power input terminal of the second stage is connected to a fourth metal trace of the substrate;

the third stage comprises a second power input terminal;

the second power input terminal of the third stage is connected to a fifth metal trace of the substrate; and the second power input terminal of the first stage, the second power input terminal of the second stage, and the second power input terminal of the third stage are all provided with a second voltage level that is different from the first voltage level.

13. The electronic device of claim 10, wherein the first stage comprises a second power input terminal;

the second power input terminal of the first stage is connected to a third metal trace of the substrate;

the second stage comprises a second power input terminal;

the second power input terminal of the second stage is connected to a fourth metal trace of the substrate;

the third stage comprises a second power input terminal;

the second power input terminal of the third stage is connected to the third metal trace of the substrate; and the second power input terminal of the first stage, the second power input terminal of the second stage, and the second power input terminal of the third stage are all provided with a second voltage level that is different from the first voltage level.

14. The electronic device of claim 1, wherein the substrate is a flexible substrate.

15. The electronic device of claim 14, further comprising:

a display panel; and a control board, wherein the flexible substrate is configured to connect the display panel to the control board.

16. The electronic device of claim 1, wherein the substrate is an array substrate of a display panel.

17. The electronic device of claim 16, further comprising the display panel.

18. A display driver chip comprising a molding compound and a die embedded in the molding compound, the die comprising a plurality of operational amplifiers, each of the operational amplifiers comprising a first stage and a second stage, wherein the first stage comprises a first power input terminal connected to a first pad that is exposed from the molding compound;

the second stage comprises a first power input terminal and an output terminal for outputting an output voltage;

the first power input terminal of the second stage is connected to a second pad that is exposed from the molding compound; and the first power input terminal of the first stage and the first power input terminal of the second stage are both provided with a first voltage level.

19. The display driver chip of claim 18, wherein the first stage comprises a second power input terminal;

the second stage comprises a second power input terminal;

the second power input terminal of the first stage and the second power input terminal of the second stage are both connected to a third pad that is exposed from the molding compound; and the second power input terminal of the first stage and the second power input terminal of the second stage are both provided with a second voltage level that is different from the first voltage level.

20. The display driver chip of claim 18, wherein the first stage comprises a second power input terminal;

the second power input terminal of the first stage is connected to a third pad that is exposed from the molding compound;

the second stage comprises a second power input terminal;

the second power input terminal of the second stage is connected to a fourth pad that is exposed from the molding compound; and the second power input terminal of the first stage and the second power input terminal of the second stage are both provided with a second voltage level that is different from the first voltage level.

21. The display driver chip of claim 18, wherein each of the operational amplifiers comprises a third stage coupled to the first stage or between the first stage and the second stage, wherein the third stage comprises a first power input terminal;

the first power input terminal of the third stage is connected to a third pad that is exposed from the molding compound; and the first power input terminal of the third stage is provided with the first voltage level.

22. The display driver chip of claim 21, wherein the first stage comprises a second power input terminal;

the second stage comprises a second power input terminal;

the third stage comprises a second power input terminal;

the second power input terminal of the first stage, the second power input terminal of the second stage, and the second power input terminal of the third stage are all connected to a fourth pad that is exposed from the molding compound; and the second power input terminal of the first stage, the second power input terminal of the second stage, and the second power input terminal of the third stage are all provided with a second voltage level that is different from the first voltage level.

23. The display driver chip of claim 21, wherein the first stage comprises a second power input terminal;

the third stage comprises a second power input terminal;

the second power input terminal of the first stage and the second power input terminal of the third stage are both connected to a fourth pad that is exposed from the molding compound;

the second stage comprises a second power input terminal;

the second power input terminal of the second stage is connected to a fifth pad that is exposed from the molding compound; and the second power input terminal of the first stage, the second power input terminal of the second stage, and the second power input terminal of the third stage are all provided with a second voltage level that is different from the first voltage level.

24. The display driver chip of claim 21, wherein the first stage comprises a second power input terminal;

the second power input terminal of the first stage is connected to a fourth pad that is exposed from the molding compound;

the second stage comprises a second power input terminal;

the second power input terminal of the second stage is connected to a fifth pad that is exposed from the molding compound;

the third stage comprises a second power input terminal;

the second power input terminal of the third stage is connected to a sixth pad that is exposed from the molding compound; and the second power input terminal of the first stage, the second power input terminal of the second stage, and the second power input terminal of the third stage are all provided with a second voltage level that is different from the first voltage level.

25. The display driver chip of claim 18, wherein each of the operational amplifiers comprises a third stage coupled to the first stage or between the first stage and the second stage, wherein the third stage comprises a first power input terminal;

the first power input terminal of the third stage is connected to the first pad; and the first power input terminal of the third stage is provided with the first voltage level.

26. The display driver chip of claim 25, wherein the first stage comprises a second power input terminal;

the second stage comprises a second power input terminal;

the third stage comprises a second power input terminal;

the second power input terminal of the first stage, the second power input terminal of the second stage, and the second power input terminal of the third stage are all connected to a third pad that is exposed from the molding compound; and the second power input terminal of the first stage, the second power input terminal of the second stage, and the second power input terminal of the third stage are all provided with a second voltage level that is different from the first voltage level.

27. The display driver chip of claim 25, wherein the first stage comprises a second power input terminal;

the second power input terminal of the first stage is connected to a third pad that is exposed from the molding compound;

the second stage comprises a second power input terminal;

the second power input terminal of the second stage is connected to a fourth pad that is exposed from the molding compound;

the third stage comprises a second power input terminal;

the second power input terminal of the third stage is connected to a fifth pad that is exposed from the molding compound; and the second power input terminal of the first stage, the second power input terminal of the second stage, and the second power input terminal of the third stage are all provided with a second voltage level that is different from the first voltage level.

28. The display driver chip of claim 25, wherein the first stage comprises a second power input terminal;

the second power input terminal of the first stage is connected to a third pad that is exposed from the molding compound;

the second stage comprises a second power input terminal;

the second power input terminal of the first stage is connected to a fourth pad that is exposed from the molding compound;

the third stage comprises a second power input terminal;

the second power input terminal of the third stage is connected to the third pad; and the second power input terminal of the first stage, the second power input terminal of the second stage, and the second power input terminal of the third stage are all provided with a second voltage level that is different from the first voltage level.

* * * * *